US007522148B2

(12) United States Patent
Maki

(10) Patent No.: US 7,522,148 B2
(45) Date of Patent: Apr. 21, 2009

(54) SOURCE DRIVER, ELECTRO-OPTICAL DEVICE, ELECTRONIC APPARATUS, AND DRIVING METHOD

(75) Inventor: Katsuhiko Maki, Nagano (JP)

(73) Assignee: Seiko Epson Corporation (JP)

( * ) Notice: Subject to any disclaimer, the term of this patent is extended or adjusted under 35 U.S.C. 154(b) by 738 days.

(21) Appl. No.: 11/220,346

(22) Filed: Sep. 6, 2005

(65) Prior Publication Data

US 2006/0050065 A1 Mar. 9, 2006

(30) Foreign Application Priority Data

Sep. 7, 2004 (JP) ..... 2004-259698

(51) Int. Cl.
*G09G 3/36* (2006.01)

(52) U.S. Cl. ..... 345/100; 345/98; 345/690; 345/698; 345/204

(58) Field of Classification Search ..... 345/87, 345/98–100, 204, 211, 690, 698
See application file for complete search history.

(56) References Cited

U.S. PATENT DOCUMENTS

| | | | | |
|---|---|---|---|---|
| 6,331,847 | B1 | 12/2001 | Kim et al. | |
| 6,496,175 | B1 | 12/2002 | Fukuo | |
| 7,030,869 | B2 * | 4/2006 | Morita | 345/208 |
| 7,050,028 | B2 * | 5/2006 | Morita | 345/90 |
| 7,106,321 | B2 | 9/2006 | Morita | |
| 7,286,125 | B2 * | 10/2007 | Morita | 345/211 |
| 2004/0233226 | A1 | 11/2004 | Toriumi et al. | |
| 2006/0038764 | A1 | 2/2006 | Takahashi et al. | |

FOREIGN PATENT DOCUMENTS

| | | |
|---|---|---|
| JP | 11-150427 | 6/1999 |
| JP | 11-184434 | 7/1999 |
| JP | 11-305744 | 11/1999 |
| JP | 2000-295044 | 10/2000 |
| JP | 2002-351413 | 12/2002 |
| JP | 2003-233357 | 8/2003 |
| JP | 2004-233771 | 8/2004 |
| JP | 2006-058360 | 3/2006 |

* cited by examiner

*Primary Examiner*—Henry N Tran
*Assistant Examiner*—Solomon Berhane
(74) *Attorney, Agent, or Firm*—Harness, Dickey & Pierce, P.L.C.

(57) ABSTRACT

A source driver for driving a source line included in an electro-optical device, includes: an impedance conversion circuit which drives the source line based on a grayscale voltage corresponding to display data; a first switch circuit including one end to which a non-display voltage is supplied and another end coupled to an output of the impedance conversion circuit; a power save data holding circuit provided corresponding to each impedance conversion circuit or to impedance conversion circuits corresponding to a plurality of dots making up a pixel, and for holding power save data; and a first mask circuit for masking the power save data based on a first mask control signal that varies in unit of a horizontal scan period. When power save control is performed based on an output from the first mask circuit, an operational current of the impedance conversion circuit is suspended or restricted to set an output of the impedance conversion circuit as a high impedance state and the first switch circuit is set to a conducting state. When power save control is not performed based on an output from the first mask circuit, the impedance conversion circuit drives the output of the impedance conversion circuit based on the grayscale voltage and the first switch circuit is set to a non-conducting state.

11 Claims, 32 Drawing Sheets

| PSD | STATUS |
|---|---|
| H | POWER-SAVE OFF |
| L | POWER-SAVE ON |

FIG. 8A

| PTV | STATUS |
|---|---|
| H | VERTICAL PARTIAL PERIOD SELECTION |
| L | REGULAR DISPLAY PERIOD SELECTION |

FIG. 8B

| PTH | STATUS |
|---|---|
| H | HORIZONTAL PARTIAL PERIOD SELECTION |
| L | REGULAR DISPLAY PERIOD SELECTION |

FIG. 8C

| ALLPS | STATUS |
|---|---|
| H | FORCED POWER-SAVE ON |
| L | FORCED POWER-SAVE OFF |

FIG. 8D

| DIFFERENTIAL PART | OUTPUT PART | NO LOAD | LOAD CONNECTED |
|---|---|---|---|
| LOW SLEW RATE | HIGH SLEW RATE | HIGH PHASE MARGIN | LOW PHASE MARGIN |
| HIGH SLEW RATE | LOW SLEW RATE | LOW PHASE MARGIN | HIGH PHASE MARGIN |
| SAME | | LOW PHASE MARGIN | HIGH PHASE MARGIN |

FIG. 19

SOURCE DRIVER, ELECTRO-OPTICAL DEVICE, ELECTRONIC APPARATUS, AND DRIVING METHOD

Japanese Patent Application No. 2004-259698, filed on Sep. 7, 2004, is hereby incorporated by reference in its entirety.

BACKGROUND OF THE INVENTION

The present invention relates to a source driver, an electro-optical device and an electronic apparatus having the source driver, and a driving method.

Simple matrix liquid crystal display panels and active matrix liquid crystal display panels using switching elements, such as thin-film transistors (TFT), are known as liquid crystal panels (electro-optical devices) used in cellular phones and other electronic apparatuses.

The simple matrix method can reduce power consumption easily compared to the active matrix method, but is not suited to display multiple colors and moving images. Meanwhile, although the active matrix method is suited to display multiple colors and moving images, the method is not good for reducing power consumption.

The demand for multi-color, moving imaging has increased in recent years to provide high quality images with cellular phones and other mobile electronic apparatuses. In response to this demand, active matrix liquid crystal display panels are increasingly replacing simple matrix liquid crystal display panels.

To drive an active matrix liquid crystal display panel, an impedance conversion circuit functioning as an output buffer is provided in a source driver that drives source lines of the display. As this impedance conversion circuit, an operational amplifier that has a connection to be a voltage follower circuit is adopted. This configuration provides high driving capability, but increases power consumption because of the operating current of the operational amplifier. In driving this kind of liquid crystal display panel, a method for turning part of its displayable area to a display status and other parts to a non-display status has been employed to reduce power consumption. Japanese Unexamined Patent Application Laid-Open No. 11-184434 is an example of related art.

In an active matrix liquid crystal display panel including a plurality of source lines and a plurality of gate lines, display and non-display areas are set in a displayable area of the panel to provide a partial display. The display area is part of the displayable area that is turned to a display status, while the non-display area is other part that is turned to a non-display status. The two areas are divided by the source and gate lines. The display or non-display status of each area is set by a source driver for driving the source lines and a gate driver for driving the gate lines In order for the source driver to provide a partial display divided by the source lines, the driver loads "off" display data for turning a non-display area to the non-display status, as well as display data for displaying an image in a display area. The source driver then drives some source lines in the display area based on the display data, and also drives other source lines in the non-display area based on the "off" display data. Accordingly, a voltage of the source lines is applied to a pixel electrode coupled to selected gate lines, and thus the display and non-display statuses can be set.

To provide a partial display divided by the gate lines, however, the gate driver outputs a selection voltage to some gate lines in a display area, outputs this selection voltage once to other gate lines in a non-display area, and then needs to control not to output this selection voltage again to the gate lines in the non-display area in and after the next frame. Therefore, the source driver has to drive source lines on one scan line every time irrespective of whether they are in the display or non-display area divided by gate lines. Consequently, the source driver consumes unnecessary power as it drives source lines in a non-display area although it is divided by gate lines.

An operational amplifier of an impedance conversion circuit for driving source lines is provided with a capacitor for preventing oscillation in its path in which its output is returned.

However, such a capacitor for preventing oscillation provided to the operational amplifier makes it difficult to reduce circuit size. When applying it as an output buffer to the source driver, in particular, one operational amplifier is provided for every 720 source lines, for example, which increases a chip area and cost.

In addition, the operational amplifier includes a differential amplifier and an output circuit, for example. The reaction (response) rate of the output circuit may be much higher than that of the differential amplifier. In this case, an increased load capacity decreases the reaction rate of the output circuit. As a result, the reaction rate of the output circuit becomes closer to that of the differential amplifier, and thereby oscillation becomes likely. This means that oscillation margin becomes low, since a larger liquid crystal panel increases the output load of the operational amplifier.

Furthermore, it is necessary to change a capacity of the capacitor for preventing oscillation. Therefore, providing such a capacitor inside a circuit makes it necessary to provide an extra switching element for trimming the capacitor, and deteriorates characteristics of the capacitor itself.

In consideration of the need for less costly, larger liquid crystal panels, the voltage follower circuit preferably has a lower phase margin with load unconnected to its output than with load connected to its output. Accordingly, there is no need to provide the capacitor for preventing oscillation. As a result, a phase margin increases as the size of a liquid crystal panel increases and its output load increases, and thereby oscillation can be prevented.

SUMMARY

A first aspect of the invention relates to a source driver for driving a source line included in an electro-optical device, the source driver comprising: an impedance conversion circuit which drives the source line based on a grayscale voltage corresponding to display data;

a first switch circuit including one end to which a non-display voltage is supplied and another end coupled to an output of the impedance conversion circuit;

a power save data holding circuit provided corresponding to each impedance conversion circuit or to impedance conversion circuits corresponding to a plurality of dots making up a pixel, and for holding power save data; and a first mask circuit for masking the power save data based on a first mask control signal that varies in unit of a horizontal scan period, wherein when power save control is performed based on an output from the first mask circuit, an operational current of the impedance conversion circuit is suspended or restricted to set an output of the impedance conversion circuit as a high impedance state and the first switch circuit is set to a conducting state, and wherein when power save control is not performed based on an output from the first mask circuit, the impedance conversion circuit drives the output of the impedance conversion circuit based on the grayscale voltage and the first switch circuit is set to a non-conducting state.

A second aspect of the invention relates to an electro-optical device, comprising:

a plurality of source lines;

a plurality of gate lines;

a plurality of switching elements, each of the switching elements being coupled to one of the plurality of gate lines and one of the plurality of source lines;

a gate driver for scanning the plurality of gate lines; and the above source driver which drives the plurality of source lines.

A third aspect of the invention relates to an electronic apparatus, comprising the above electro-optical device.

A fourth aspect of the invention relates to a method for driving a source line included in an electro-optical device, comprising:

holding power save data for each impedance conversion circuit which drives the source line based on a grayscale voltage corresponding to display data or for impedance conversion circuits corresponding to a plurality of dots making up a pixel; and based on a result of masking the power save data based on a first mask control signal which varies in unit of a horizontal scan period, suspending or restricting an operational current of the impedance conversion circuit to set an output of the impedance conversion circuit as a high impedance state and supplying a non-display voltage to the output of the impedance conversion circuit, or making the impedance conversion circuit drive the output of the impedance conversion circuit based on the grayscale voltage.

BRIEF DESCRIPTION OF THE DRAWINGS

FIGS. 8A through 8D describe the signals shown in FIG. 7;

FIG. 19 illustrates the relation between the slew rate of outputs of the differential and output parts shown in FIG. 18 and oscillation;

DETAILED DESCRIPTION OF THE EMBODIMENTS

Figure 1:
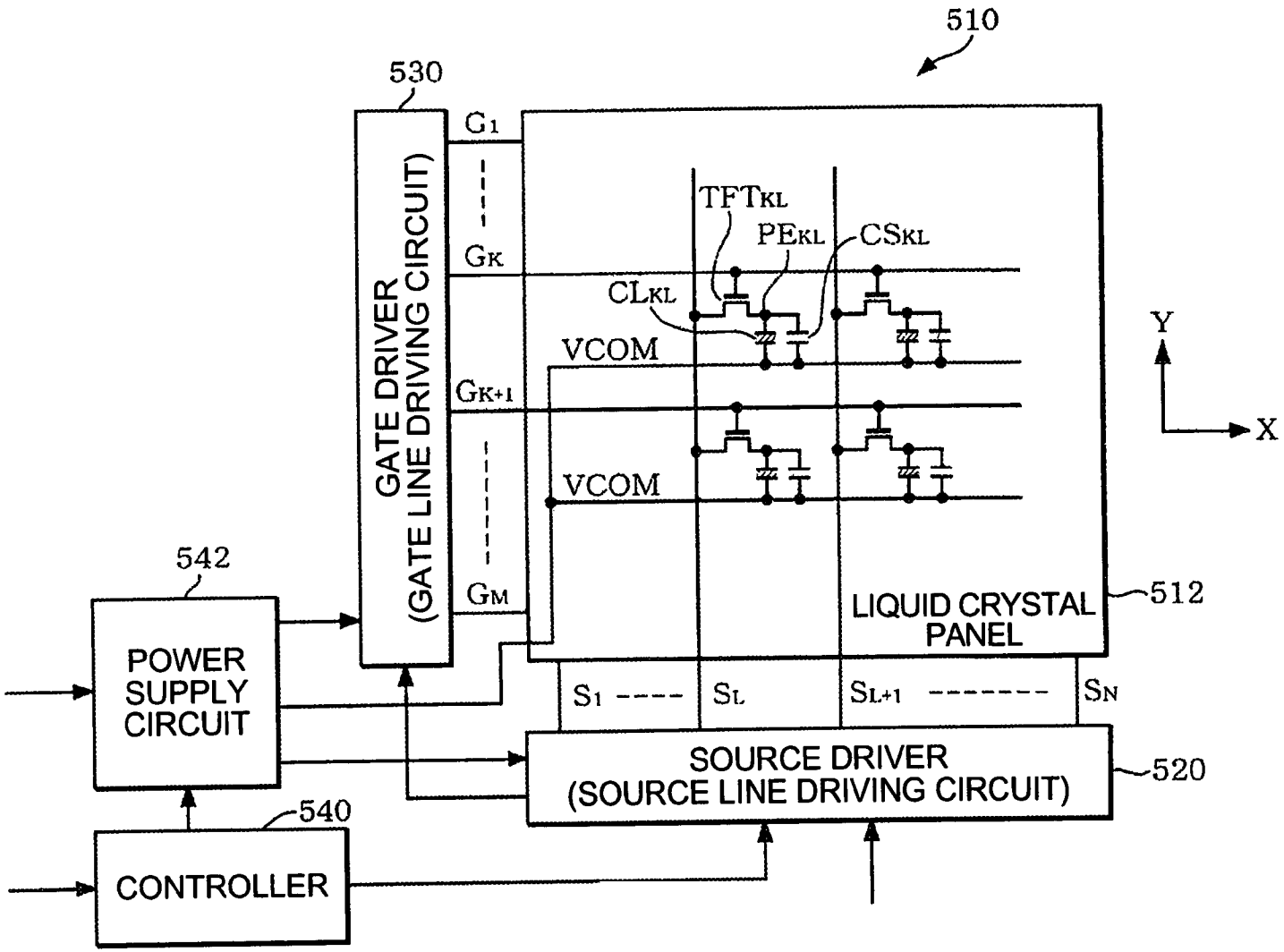
FIG. 1 is a block diagram schematically showing an electro-optical device to which a source driver according to one embodiment of the invention is applied.

An advantage of the present invention is to provide a source driver, an electro-optical device, an electronic apparatus, and a driving method that can reduce power consumption with a partial display and reduce cost with a smaller chip area.

A source driver according to one embodiment of the invention for driving a source line included in an electro-optical device includes:

an impedance conversion circuit which drives the source line based on a grayscale voltage corresponding to display data;

a first switch-circuit including one end to which a non-display voltage is supplied and another end coupled to an output of the impedance conversion circuit;

a power save data holding circuit provided corresponding to each impedance conversion circuit or to impedance conversion circuits corresponding to a plurality of dots making up a pixel, and for holding power save data; and a first mask circuit for masking the power save data based on a first mask control signal that varies in unit of a horizontal scan period, wherein when power save control is performed based on an output from the first mask circuit, an operational current of the impedance conversion circuit is suspended or restricted to set an output of the impedance conversion circuit as a high impedance state and the first switch circuit is set to a conducting state, and wherein when power save control is not performed based on an output from the first mask circuit, the impedance conversion circuit drives the output of the impedance conversion circuit based on the grayscale voltage and the first switch circuit is set to a non-conducting state.

This structure makes it possible to specify the impedance conversion operations of which impedance conversion circuits are suspended for each output or outputs corresponding to dots making up a pixel. Thus, the power save control of the impedance conversion circuits can be set in detail. Moreover, it is possible to control not to drive source lines in scanning an area that does not require driving without unnecessary control over the gate driver. Therefore, it is possible to further reduce power consumption.

Moreover, irrespective of the power save data held by the power save data holding circuit based on the first mask control signal, the impedance conversion circuit and the first switch circuit can be set so as to make the power save control unnecessary, or to turn on or off the power save control depending on the power save data. Accordingly, detailed partial display control effectively reduce unnecessary current consumption.

In the source driver, the impedance conversion circuit may have a lower phase margin with load unconnected to the output of the impedance conversion circuit than with load connected to the output.

In a typical test for evaluate electrical characteristics or performance of source drivers, test load is connected to part of its (test) impedance conversion circuits, and other (non-test) impedance conversion circuits remain unconnected to load. Using the impedance conversion circuit according to the present embodiment of the invention makes it easy for the non-test impedance conversion circuits to oscillate, resulting in inaccurate evaluation of electrical characteristics, but can do without a capacitor for preventing oscillation.

Accordingly, by providing the power save data holding circuit corresponding to each impedance conversion circuit or impedance conversion circuits corresponding to a plurality of dots making up a pixel, it is possible to set only the test impedance conversion circuits enable, making the oscillation of the non-test impedance conversion circuits have little influence. As a result, a source driver including impedance conversion circuits can be achieved that requires no capacitor for preventing oscillation and provides accurate evaluation. In other words, this source driver can not only reduce cost with a smaller chip area, but also reduce test costs.

The source driver may also include a second mask circuit which masks the power save data based on a second mask control signal which varies in unit of a horizontal scan period, and the first mask circuit may mask an output from the second mask circuit based on the first mask control signal.

Accordingly, driving of the source lines can be suspended based on the second mask control signal in scanning a non-display area divided by the source lines, which further reduces power consumption.

The source driver may also include a second switch circuit for bypassing an input to and output from the impedance conversion circuit, and during a first period within a horizontal scan period specified by a driving period specifying signal that varies within a horizontal scan period, the second switch circuit may be set to a non-conducting state based on an output from the first mask circuit and the impedance conversion circuit may drive the output of the impedance conversion circuit based on the grayscale voltage, and during a second period following the first period, the second switch circuit may be set to a conducting state and an operational current of the impedance conversion circuit may be suspended or restricted to set the output of the impedance conversion circuit as a high impedance state.

Accordingly, the operational current of the impedance circuit, which is a major part of the current consumption, can be reduced to minimum.

The source driver may also include a display data memory for storing the display data, and a predetermined bit of the display data read from the display data memory may be stored in the power save data holding circuit as power save data.

Accordingly, power save data can be set for the source driver in the same manner as display data, and thereby reducing additional circuits for setting the power save data to minimum.

In the source driver, the impedance conversion circuit may include a voltage follower circuit to which the grayscale voltage is supplied as an input signal; and a resistance circuit coupled in series with an output of the voltage follower circuit, the voltage follower circuit may include:

a differential part which amplifies a differential between the input signal and an output signal from the voltage follower circuit; and an output part which outputs an output signal from the voltage follower circuit based on an output from the differential part, and the source line may be driven via the resistance circuit.

Accordingly, the source lines are driven via the resistance circuit provided to the output of the voltage follower circuit that is typically used for converting infinitely large input impedance into smaller impedance. Thus the slew rate (response rate) of the output part can be adjusted with the resistance value of the resistance circuit and the load capacity of the source lines. Therefore, there is no need to provide a capacitor for phase compensation to the impedance conversion circuit to prevent oscillation determined by the relationship between the slew rate at the output of the differential part and the slew rate at the output of the output part for returning the output to the differential part.

In the source driver, the slew rate at an output of the differential part may be equal to or larger than the slew rate at an output of the output part.

Here, a phase margin of the impedance conversion circuit with load unconnected is low, while the slew rate at the output of the output part with load connected is low, making the phase margin of the impedance conversion circuit large. Accordingly, oscillation can be surely prevented when load is connected by adjusting a phase margin when load is unconnected.

An electro-optical device according to another embodiment of the invention includes a plurality of source lines, a plurality of gate lines, a plurality of switching elements, each of the switching elements being coupled to one of the plurality of gate lines and one of the plurality of source lines, a gate driver for scanning the plurality of gate lines, and the above-mentioned source driver which drives the plurality of source lines.

Accordingly, this electro-optical device can reduce power consumption and cost with a partial display.

An electronic apparatus according to yet another embodiment of the invention includes the above-mentioned electro-optical device.

Accordingly, this electronic apparatus can reduce power consumption and cost with a partial display.

A method for driving a source line included in an electro-optical according to still another embodiment of the invention includes:

holding power save data for each impedance conversion circuit which drives the source line based on a grayscale voltage corresponding to display data or for impedance conversion circuits corresponding to a plurality of dots making up a pixel; and based on a result of masking the power save data based on a first mask control signal which varies in unit of a horizontal scan period, suspending or restricting an operational current of the impedance conversion circuit to set an output of the impedance conversion circuit as a high impedance state and supplying a non-display voltage to the output of the impedance conversion circuit, or making the impedance conversion circuit drive the output of the impedance conversion circuit based on the grayscale voltage.

The driving method may also include:

based on the first mask control signal, masking a result of masking the power save data based on a second mask control signal which varies in unit of a horizontal scan period; and based on a result of masking based on the first mask control signal, suspending or restricting an operational current of the impedance conversion circuit to set the output of the impedance conversion circuit as a high impedance state and supplying a non-display voltage to the output of the impedance conversion circuit, or making the impedance conversion circuit drive the output of the impedance conversion circuit based on the grayscale voltage.

The embodiments of the present invention are described below in detail with reference to the drawings.

Embodiments of the invention will be described with reference to the accompanying drawings. Note that the embodiments described hereunder do not in any way limit the scope of the invention defined by the claims laid out herein. Note also that not all of the elements of these embodiments should be taken as essential requirements to the means of the present invention.

1. Electro-Optical Device

FIG. 1 is a block diagram showing an example of a display including an electro-optical device to which a source driver according to one embodiment of the invention is applied. As the electro-optical device, a liquid crystal panel is used in FIG. 1. Here, a display including this liquid crystal panel is referred to as a liquid crystal device.

This liquid crystal device (a display in a broad sense) 510 includes a liquid crystal panel (an electro-optical device in a broad sense) 512, a source driver (source line driving circuit) 520, a gate driver (gate line driving circuit) 530, a controller 540, and a power supply circuit 542. It should be noted that not all of these components in this circuit block are required to form the liquid crystal device 510, and part of them can be omitted.

The liquid crystal panel 512 includes a plurality of gate lines (scanning lines in a broad sense), a plurality of source lines (data lines in a broad sense), and a pixel electrode defined by the gate and source lines. In this case, an active matrix liquid crystal device is provided by coupling the source lines to a thin-film transistor (TFT or a switching element in a broad sense) and coupling the TFT to the pixel electrode.

Specifically, the liquid crystal panel 512 includes an active matrix substrate, e.g. a glass substrate. On this active matrix substrate, the following lines are arranged: a plurality of gate lines $G_1$ to $G_M$ (M is a natural number more than 1) arrayed in the Y direction of FIG. 1 and extending in the X direction; and a plurality of source lines $S_1$ to $S_N$ (N is a natural number more than 1) arrayed in the X direction and extending in the Y direction. Provided at a position corresponding to the intersection of a gate line $G_K$ ($1 \leqq K \leqq M$, K is a natural number) and a source line $S_L$ ($1 \leqq L \leqq N$, L is a natural number) is a thin-film transistor $TFT_{KL}$ (a switching element in a broad sense).

The $TFT_{KL}$ has a gate electrode coupled to the gate line $G_K$, a source electrode coupled to the source line $S_L$, and a drain electrode coupled to a pixel electrode $PE_{KL}$. Provided between this pixel electrode $PE_{KL}$ and a counter electrode VCOM (common electrode) placed face to face with the pixel electrode $PE_{KL}$ with a liquid crystal element (an electro-optical material in a broad sense) therebetween are a liquid crystal capacitance $CL_{KL}$ (liquid crystal element) and an auxiliary capacitance $CS_{KL}$. Liquid crystal is sealed to fill a space between the active matrix substrate having the $TFT_{KL}$, the pixel electrode $PE_{KL}$, etc., and a counter substrate having the counter electrode VCOM, such that a pixel transmission factor varies depending on a voltage applied between the pixel electrode $PE_{KL}$ and the counter electrode VCOM.

A voltage supplied to the counter electrode VCOM is generated by the power supply circuit 542. The counter electrode VCOM may be, instead of being provided on the entire surface of the counter substrate, provided in strips corresponding to individual gate lines.

The source driver 520 drives the source lines $S_1$ to $S_N$ of the liquid crystal panel 512 in accordance with display data (image data). Meanwhile, the gate driver 530 sequentially scans the gate lines $G_1$ to $G_M$ of the liquid crystal panel 512.

The controller 540 controls the source driver 520, the gate driver 530, and the power supply circuit 542 in accordance with what has been set by a host (not shown), such as a central processing unit (CPU).

With respect to the source driver 520, the controller 540 or host sets operational modes of the source driver 520 and the gate driver 530 and supplies vertical and horizontal synchronous signals it generates, for example. With respect to the power supply circuit 542, the controller 540 or host controls the polarity inversion timing of a voltage of the counter electrode VCOM. The source driver 520 provides the gate driver 530 with a gate driver control signal depending on what has been set by the controller 540 or host. Based on this gate driver control signal, the gate driver 530 is controlled. The source driver 520 also receives the polarity inversion timing of a voltage of the counter electrode VCOM. In synchronization with this polarity inversion timing, the source driver 520 generates a polarity inversion signal POL that will be described later.

The power supply circuit 542 generates various kinds of voltages required for driving of the liquid crystal panel 512 and a voltage of the counter electrode VCOM based on a reference voltage supplied externally.

While the liquid crystal device 510 includes the controller 540 in FIG. 1, the controller 540 may be provided outside the liquid crystal device 510. Alternatively, the host may be included together with the controller 540 in the liquid crystal device 510. Also, any or all of the source driver 520, the gate driver 530, the controller 540, and the power supply circuit 542 may be provided on the liquid crystal panel 512.

1.1 Source Driver

Figure 2:
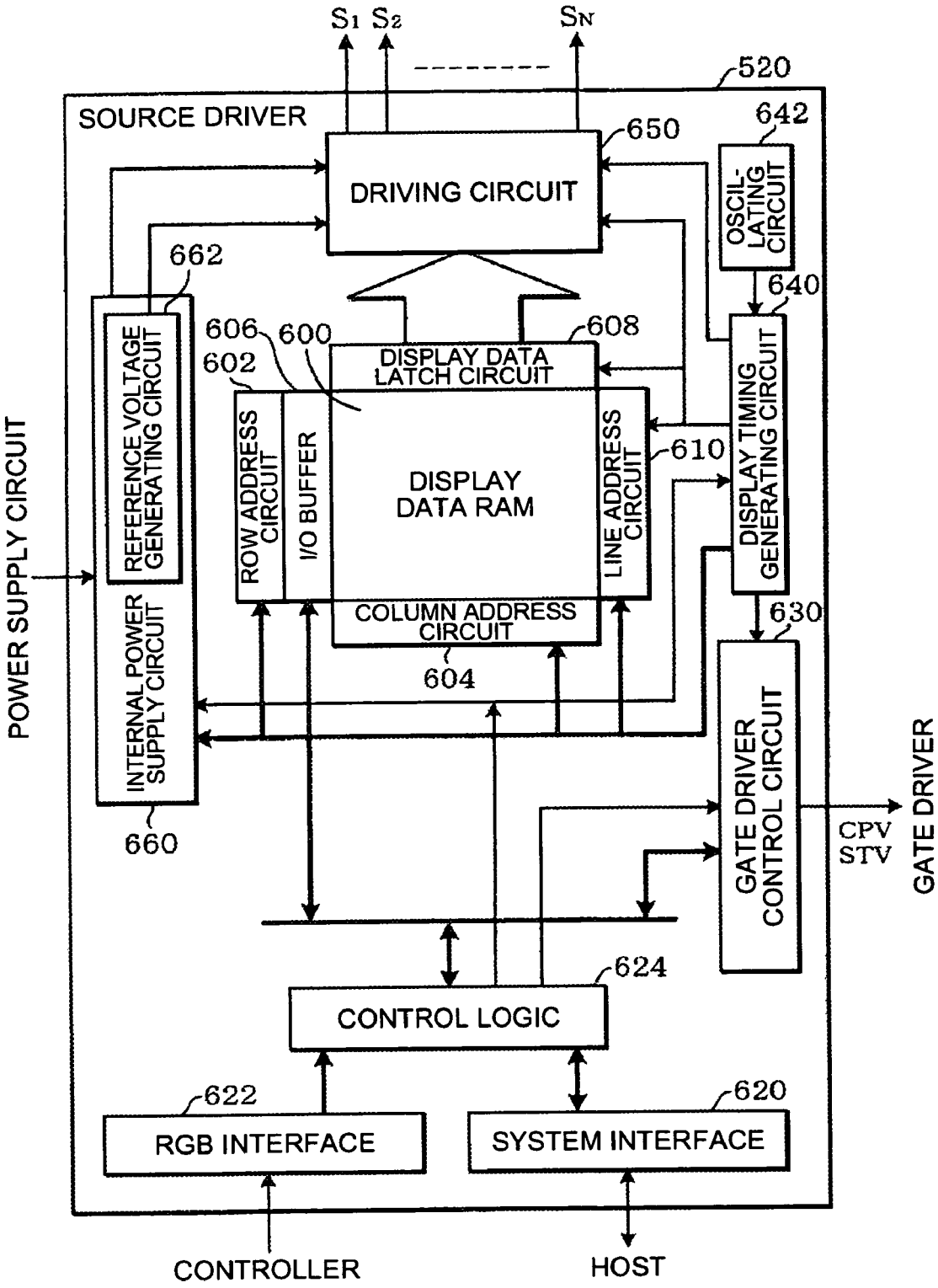
FIG. 2 is a block diagram showing an example configuration of the source driver according to the present embodiment.

FIG. 2 shows an example configuration of the source driver 520 shown in FIG. 1.

The source driver 520 includes a display data random access memory (RAM) 600 as a display data memory. The display data RAM 600 stores display data of a still or moving image. The display data RAM 600 stores display data of at least one frame. For example, the host transfers display data of a still image directly to the source driver 520. For another example, the controller 540 transfers display data of a moving image to the source driver 520.

The source driver 520 also includes a system interface circuit 620 for interfacing with the host. The system interface circuit 620 performs interface processing of signals received from and sent to the host. This processing enables the host, via the system interface circuit 620, to set a control command and display data of a still image in the source driver 520 and to read the status read of the source driver 520 and the display data RAM 600.

The source driver 520 also includes an RGB interface circuit 622 for interfacing with the controller 540. The RGB interface circuit 622 performs interface processing of signals received from and sent to the controller 540. This processing enables the controller 540, via the RGB interface circuit 622, to set display data of a moving image in the source driver 520.

The system interface circuit 620 and the RGB interface circuit 622 are coupled to a control logic 624. The control logic 624 is a circuit block that controls the whole of the source driver 520. The control logic 624 controls writing of display data input via the system interface circuit 620 or the RGB interface circuit 622 in the display data RAM 600.

The control logic 624 also decodes a control command input from the host via the system interface circuit 620, and outputs a control signal depending on the decode result to control each part of the source driver 520. If a control command directs reading from the display data RAM 600, for example, the control logic outputs the display data that have been read from the display data RAM 600 to the host via the system interface circuit 620. The control logic 624 also controls setting of power save (PS) data that will be described later in response to a control command.

The source driver 520 also includes a display timing generating circuit 640 and an oscillating circuit 642. The display timing generating circuit 640 generates a timing signal from a display clock generated by the oscillating circuit 642 to a display data latch circuit 608, a line address circuit 610, a driving circuit 650, and a gate driver control circuit 630.

The gate driver control circuit 630 outputs gate driver control signals (e.g. clock signal CPV for one horizontal scan period, start pulse signal STV indicating the start of one vertical scan period, reset signal) for driving the gate driver 530 in response to a control command input from the host via the system interface circuit 620.

A storage area of display data in the display data RAM 600 is specified by row and column addresses. Each row address is specified by a row address circuit 602, while each column address is specified by a column address circuit 604. Display data input via the system interface circuit 620 or the RGB interface circuit 622 are buffered by an I/O buffer circuit 606 and then written in a storage area in the display data RAM 600 that is specified by row and column addresses. Display data read from such a storage area in the display data RAM 600 that is specified by row and column addresses are buffered by the I/O buffer circuit 606 and then output via the system interface circuit 620.

The line address circuit 610 specifies a line address for reading display data to be output from the display data RAM 600 to the driving circuit 650, in synchronization with the clock signal CPV for one horizontal scan period of the gate driver control circuit 630. Such display data read from the display data RAM 600 are latched by the display data latch circuit 608 and then output to the driving circuit 650.

The driving circuit 650 includes a plurality of driving output circuits corresponding to individual outputs to the source lines. Each of the driving output circuits includes an impedance conversion circuit. The impedance conversion circuit includes a voltage follower circuit, and drives the source lines based on a grayscale voltage in accordance with display data from the display data latch circuit 608. The voltage follower circuit has a lower phase margin with load unconnected to its output than with load connected to its output.

The source driver 520 also includes an internal power supply circuit 660. The internal power supply circuit 660 generates a voltage required for a liquid crystal display by using a power supply voltage that has been supplied from the power supply circuit 542. The internal power supply circuit 660 includes a reference voltage generating circuit 662. The reference voltage generating circuit 662 generates a plurality of grayscale voltages by dividing a high potential power supply voltage (system power supply voltage) VDD and a low potential power supply voltage (system ground power supply voltage) VSS. For example, if display data per dot are composed of six bits, the reference voltage generating circuit 662 generates 64 ($=2^6$) grayscale voltages. Each grayscale voltage corresponds to each piece of display data. The driving circuit 650 selects any of the plurality of grayscale voltages, which are generated by the reference voltage generating circuit 662, based on digital display data from the display data latch circuit 608, and then outputs an analogue grayscale voltage corresponding to the digital display data to the driving output circuits. The impedance conversion circuit included in each driving output circuit buffers the grayscale voltage and outputs the voltage to a source line to drive it. Specifically, the driving circuit 650 includes impedance conversion circuits provided corresponding to each source line. Each impedance conversion circuit has a voltage follower circuit that performs impedance conversion of the grayscale voltage to output the voltage to each source line.

1.2 Gate Driver

Figure 3:
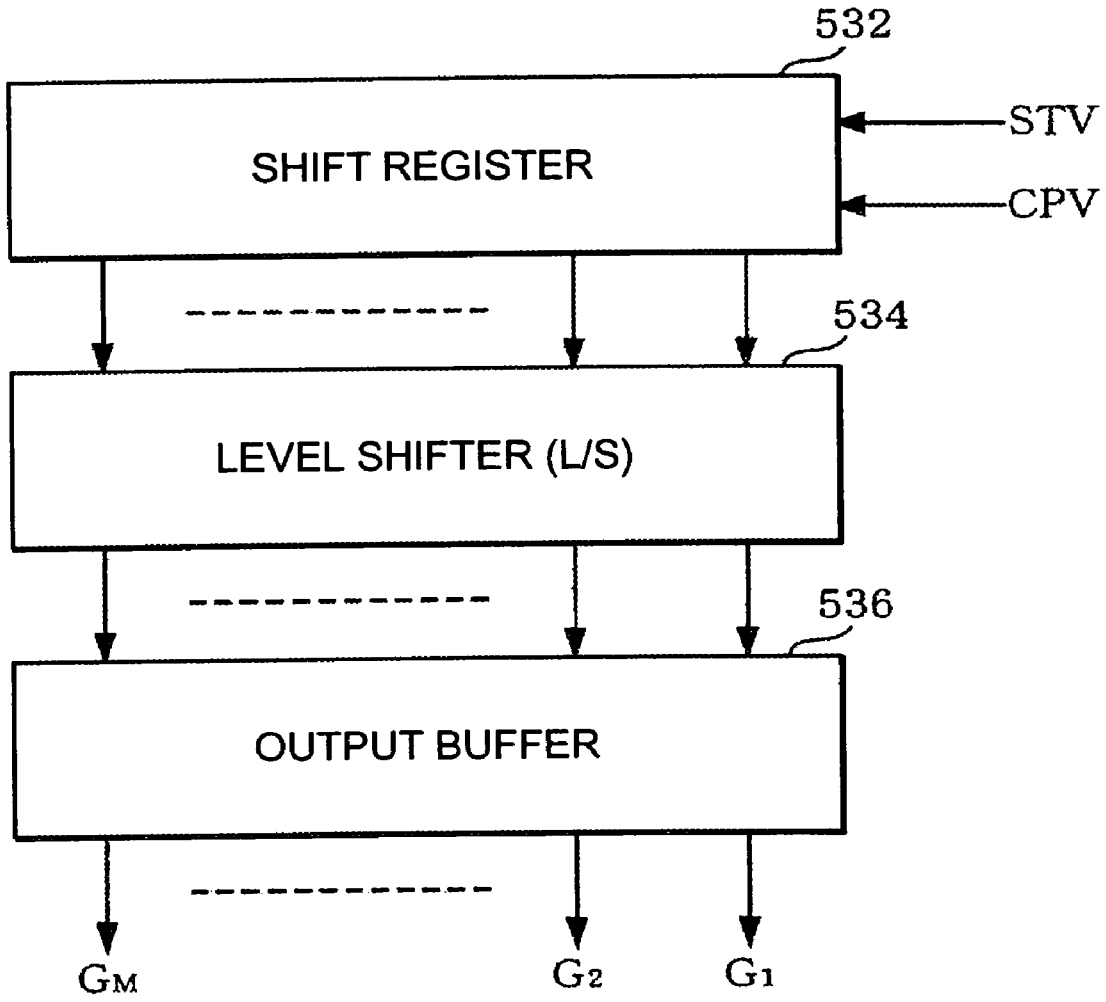
FIG. 3 is a block diagram showing an example configuration of a gate driver according to the present embodiment.

FIG. 3 shows an example configuration of the gate driver 530 shown in FIG. 1.

The gate driver 530 includes a shift register 532, a level shifter 534, and an output buffer 536.

The shift register 532 is provided corresponding to each gate line, and includes a plurality of flip-flops that are sequentially coupled. This shift register 532 holds the start pulse signal STV at a flip-flop in synchronization with the clock signal CPV from the gate driver control circuit 630, and then shifts the start pulse signal STV to an adjacent flip-flop in synchronization with the clock signal CPV sequentially. The start pulse signal STV input here is a vertical synchronizing signal from the gate driver control circuit 630.

The level shifter 534 shifts a voltage level from the shift register 532 to a voltage level in accordance with liquid crystal elements of the liquid crystal panel 512 and transistor capacity of the TFT. As this level of voltage, for example, a high voltage level of 20 to 50 V is required.

The output buffer 536 buffers a scanning voltage shifted by the level shifter 534, and outputs the voltage to the gate lines to drive the lines.

2. Source Driver of the Present Embodiment

Figure 4:
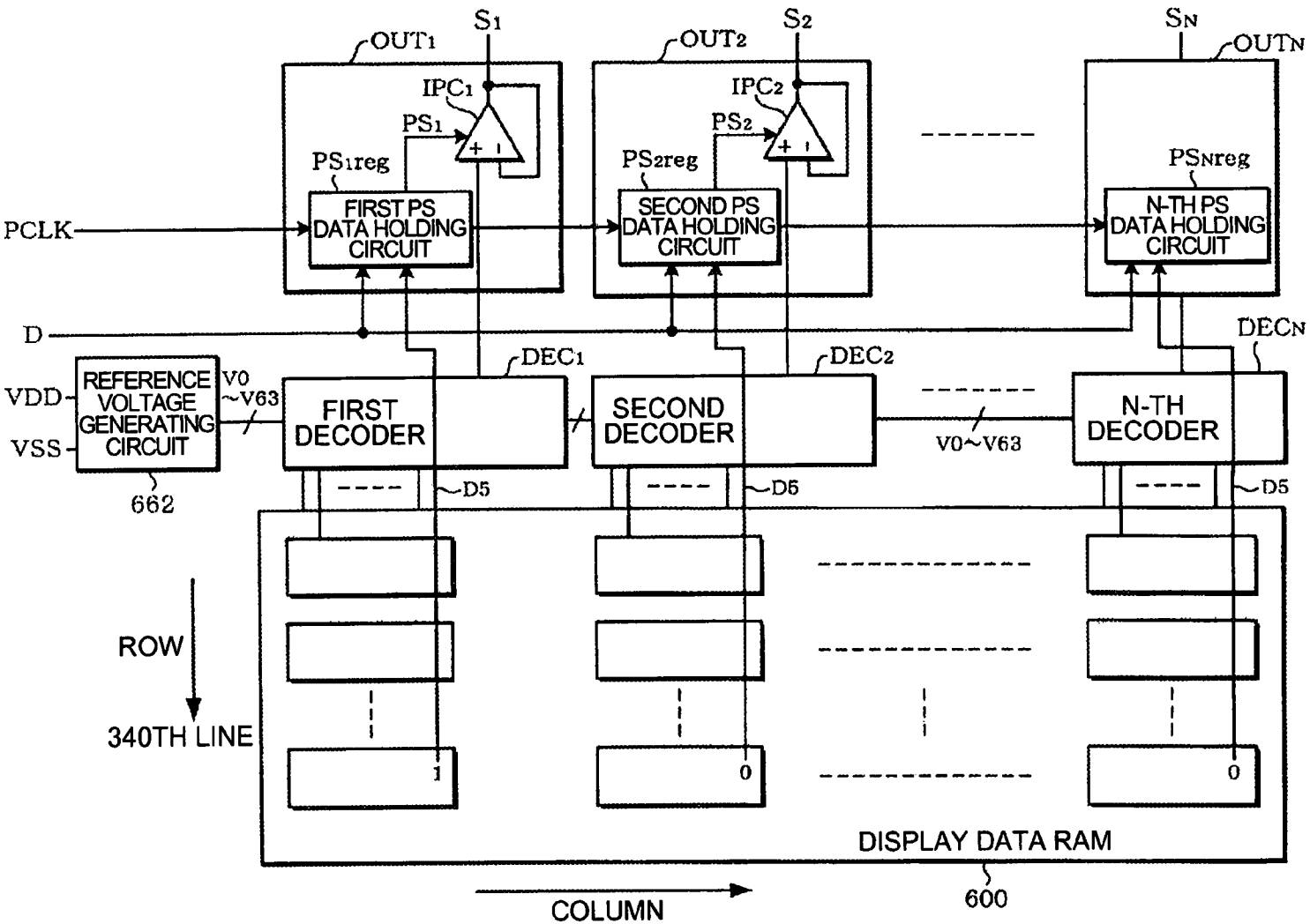
FIG. 4 is a diagram showing a main part of the source driver according to the present embodiment.

FIG. 4 shows a main part of the source driver according to the present embodiment. FIG. 4 shows an example configuration of the driving circuit 650 shown in FIG. 2. For example, display data per dot are composed of six bits, and the reference voltage generating circuit 662 generates grayscale voltages V0 to V63.

The driving circuit 650 includes driving output circuits $OUT_1$ to $OUT_N$ corresponding to individual outputs to the source lines. Each of the driving output circuits includes an impedance conversion circuit. The impedance conversion circuit includes a voltage follower circuit. Each voltage follower circuit performs impedance conversion based on the grayscale voltage supplied to its input, and drives the source line coupled to its output. The voltage follower circuit includes a differential part and an output part. The differential part has a differential amplifying circuit including a metal oxide semiconductor (MOS) transistor. The impedance conversion is initiated by flowing an operational current in the differential amplifying circuit, and is suspended by suspending or restricting the current.

The driving circuit 650 includes first to N-th decoders $DEC_1$ to $DEC_N$. Each of the first to N-th decoders $DEC_1$ to $DEC_N$ is provided corresponding to the driving output circuits (impedance conversion circuits, voltage follower circuits). Each decoder receives an input of display data D0 to D5 (including their inverted data XD0 to XD5) from the display data RAM 600, or specifically from the display data latch circuit 608. Also, each decoder is coupled to grayscale voltage signal lines GVL0 to GVL63 from the reference voltage generating circuit 662. Each decoder selects a grayscale voltage signal line corresponding to the display data D0 to D5 and XD0 to XD5, and electrically couples the selected signal line and the input of the driving output circuit. Thus the grayscale voltage selected by the decoders provided corresponding to the impedance conversion circuits (voltage follower circuits) is supplied to the input of each impedance conversion circuit (voltage follower circuit).

Figure 5:
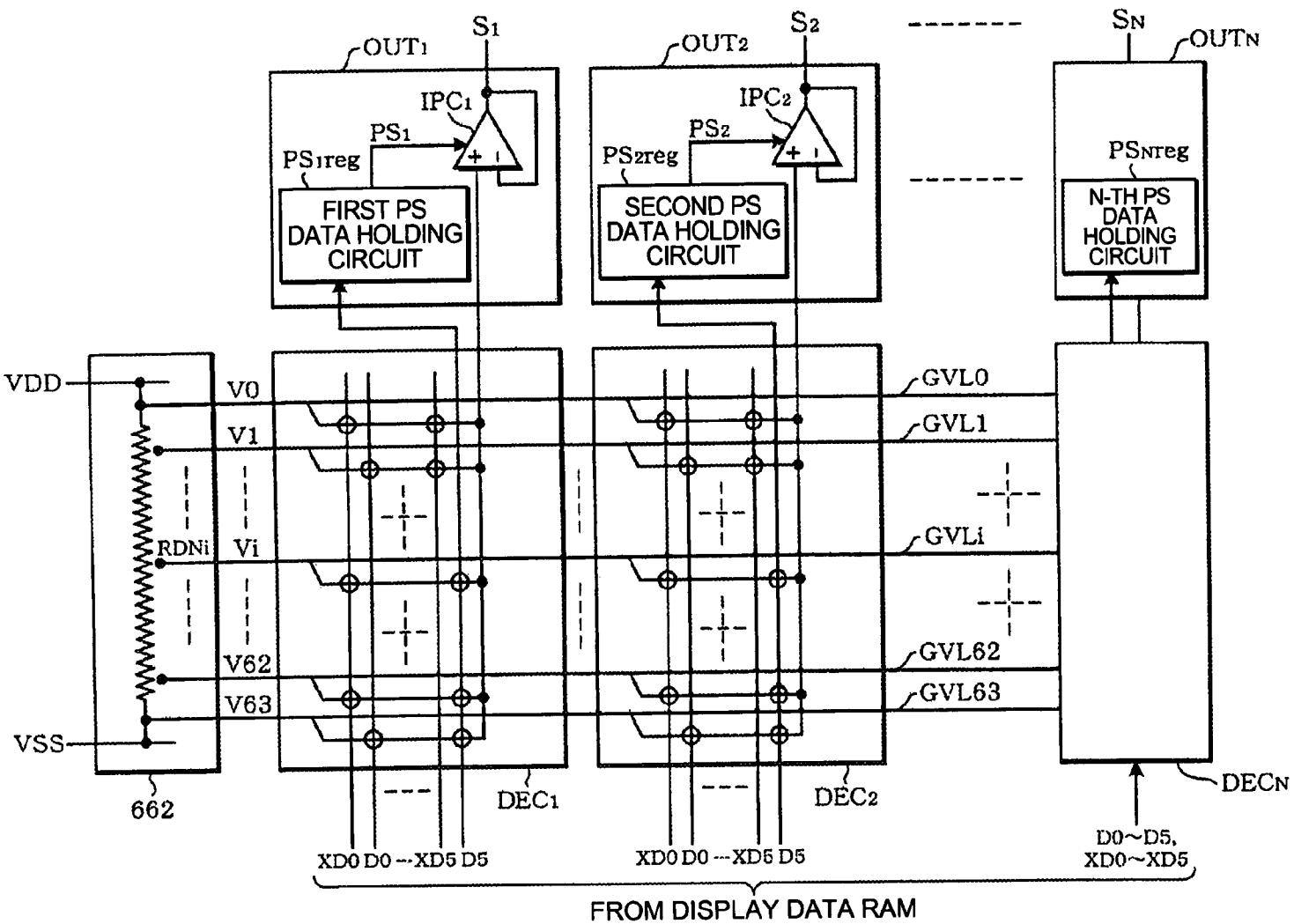
FIG. 5 is a diagram showing the source driver of FIG. 4 in greater detail.

FIG. 5 shows a configuration of the source driver of FIG. 4 in greater detail. The parts same as shown in FIG. 4 are given the same numerals in FIG. 5 and the explanation thereof will be omitted here. FIG. 5 shows an example configuration of the reference voltage generating circuit 662 and the first to N-th decoders $DEC_1$ to $DEC_N$ shown in FIG. 4.

As FIG. 5 shows, the reference voltage generating circuit 662 includes a gamma correction resistor. The gamma correction resistor outputs a divided voltage Vi ($0 \leqq i \leqq 63$, i is an integer number) obtained by dividing the resistance of a voltage between the high potential power supply voltage VDD and the low potential power supply voltage VSS as a grayscale voltage Vi to a resistive divider node RDNi. The grayscale voltage Vi is supplied to a grayscale voltage signal line GVLi.

Referring to FIGS. 4 and 5, each driving output circuit includes a PS data holding circuit besides the impedance conversion circuit. Specifically, the source driver 520 includes a plurality of impedance conversion circuits $IPC_1$ to $IPC_N$ that drive a plurality of source lines $S_1$ to $S_N$ based on a grayscale voltage supplied in response to display data, and a plurality of PS data holding circuits $PS_1$reg to $PS_N$reg provided corresponding to the plurality of impedance conversion circuits $IPC_1$ to $IPC_N$ to hold PS data.

While the PS data holding circuits are provided corresponding to the impedance conversion circuits (voltage follower circuits) in FIGS. 4 and 5, the invention is not limited to this. For example, one PS data holding circuit may be provided for impedance conversion circuits (voltage follower circuits) corresponding to a plurality of dots making up a pixel. In this case, if a pixel is composed of three (RGB) dots, one PS data holding circuit may be provided corresponding to impedance conversion circuits (voltage follower circuits) for R, G, and B components for a pixel.

Each PS data holding circuit holds PS data. The PS data make the impedance conversion operation of the impedance conversion circuits (voltage follower circuits) enable or disable.

Figure 6:
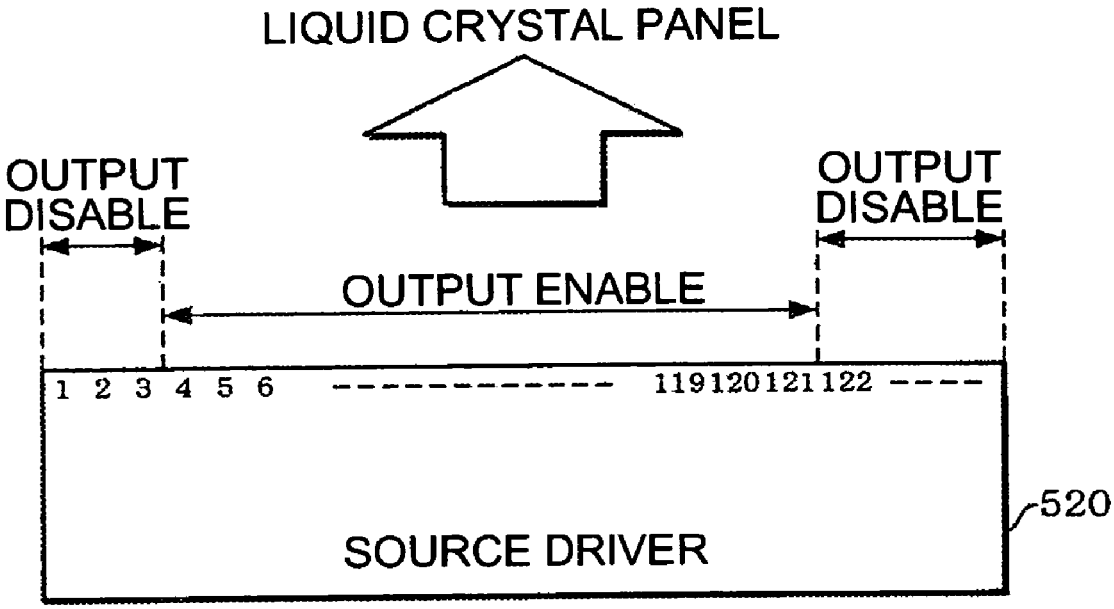
FIG. 6 is a diagram illustrating PS data according to the present embodiment.

FIG. 6 illustrates the PS data.

This drawing schematically shows outputs of N source drivers each corresponding to the source driver 520.

Some impedance conversion circuits whose impedance conversion operations are set enable drive the source lines based on a grayscale voltage. Other impedance conversion circuits whose impedance conversion operations are set disable suspend or restrict an operational current, for example, in order to suspend the impedance conversion operations, and set their outputs as a high impedance state.

As shown in FIG. 6, when setting some outputs in the middle out of the outputs of N source drivers 520 enable and other outputs at the both sides disable, the PS data held by the PS data holding circuits corresponding to the impedance conversion circuits to be set enable are set as "1", while the PS data held by the PS data holding circuits corresponding to the impedance conversion circuits to be set disable are set as "0", for example. Each voltage follower circuit included in the impedance conversion circuits controls the suspension of the impedance conversion operation based on the PS data held by the PS data holding circuits provided corresponding to the impedance conversion circuits. Specifically, power save control is released in some impedance conversion circuits corresponding to the PS data holding circuits with PS data set as "1", while power save control is carried out in other impedance conversion circuits corresponding to the PS data holding circuits with PS data set as "0".

It is thus possible to specify the impedance conversion operations of which impedance conversion circuits are suspended for each output or outputs corresponding to dots making up a pixel, and to provide detailed power save control.

For example, when providing a partial display in which source lines separate display and non-display areas, a display area can be defined in unit of a source line according to the present embodiment. Therefore, compared to the power save control on a block basis with each block composed of eight pixels, it is possible to reduce unnecessary driving of source lines and thus reduce power consumption.

Also in the present embodiment, each of the voltage follower circuits has a lower phase margin with load unconnected to its output than with load connected to its output. Accordingly, there is no need to provide a capacitor to prevent oscillation to a path through which the output returns. In addition, the reaction rate of the output is increased, and oscillation is most likely when the output is provided with no load. When part of a plurality of impedance conversion circuits is provided with test load, voltage follower circuits included in non-test impedance conversion circuits are provided with no load, and thus the voltage follower circuits included in the non-test impedance conversion circuits are likely to oscillate. If these voltage follower circuits oscillate, current consumed by the test impedance conversion circuits that share a power source with the non-test circuits cannot be accurately evaluated.

Therefore, as shown in FIGS. 4 and 5, it is required to specify the impedance conversion operations of which impedance conversion circuits (voltage follower circuits) are suspended for each output or outputs corresponding to dots making up a pixel. Accordingly, it is possible to set only the test impedance conversion circuits enable, making the oscillation of the non-test impedance conversion circuits have little influence. As a result, a source driver including impedance conversion circuits can be achieved that requires no capacitor for preventing oscillation and provides accurate evaluation. In other words, this source driver can not only reduce cost with a smaller chip area, but also reduce test costs.

The PS data are preferably set in the process of initialization, for example. To change the PS data while driving a liquid crystal panel, the data are preferably changed in a non-display period.

According to the present embodiment, the PS data to be set in the first to N-th PS data holding circuits $PS_1$reg to $PS_N$reg are set temporarily in the display data RAM 600. Subsequently, the control logic 624 or the driving circuit 650 reads the data from the display data RAM 600 and controls them to be set in the first to N-th PS data holding circuits $PS_1$reg to $PS_N$reg.

In the display data RAM 600 as shown in FIG. 4, display data of horizontal scanning lines of the liquid crystal panel 512 are stored in a storage area specified by a corresponding row address. In this case, a certain storage area in the display data RAM 600 is shared by display data and PS data. When the source driver 520 has an output of 240*3 (dots per pixel) and has 340 lines for a maximum display, a storage area for the display data of the 340th line, which is the final line of the display data RAM 600, is shared with PS data. If the PS data required for one voltage follower circuit is one bit and the number of bits for display data per dot is six (D0 to D5), then PS data are held in the storage area of the data D5, which is the highest-order bit of the display data on the 340th line.

In this case, PS data are generated to set the impedance conversion operations of a group of two impedance conversion circuits specified out of the plurality of impedance conversion circuits $IPC_1$ to $IPC_N$ enable. The PS data are set in the above-mentioned storage area in the display data RAM 600.

For example, if the impedance conversion circuits $IPC_3$ and $IPC_{121}$ shown in FIG. 6 are specified, PS data for setting the impedance conversion circuits $IPC_4$ to $IPC_{121}$ enable are generated. According to the present embodiment, PS data for setting the impedance conversion circuits $IPC_1$ to $IPC_3$ and $IPC_{122}$ to $IPC_N$ disable are also generated and set in the above-mentioned storage area in the display data RAM 600.

2.1 Driving Output Circuit

The source driver 520 according to the present embodiment drives each source line with the following driving output circuit that will be described in greater detail below, so that it can perform partial display in which display and non-display areas are separated not only by source lines but also by gate lines. Hereinafter one type of partial display in which display and non-display areas are separated by source lines is referred to as "horizontal partial display", while another type in which display and non-display areas are separated by gate lines is referred to as "vertical partial display". The horizontal partial display involves partial display control in unit of a horizontal scan period, while the vertical partial display involves partial display control within a horizontal scan period.

Figure 7:
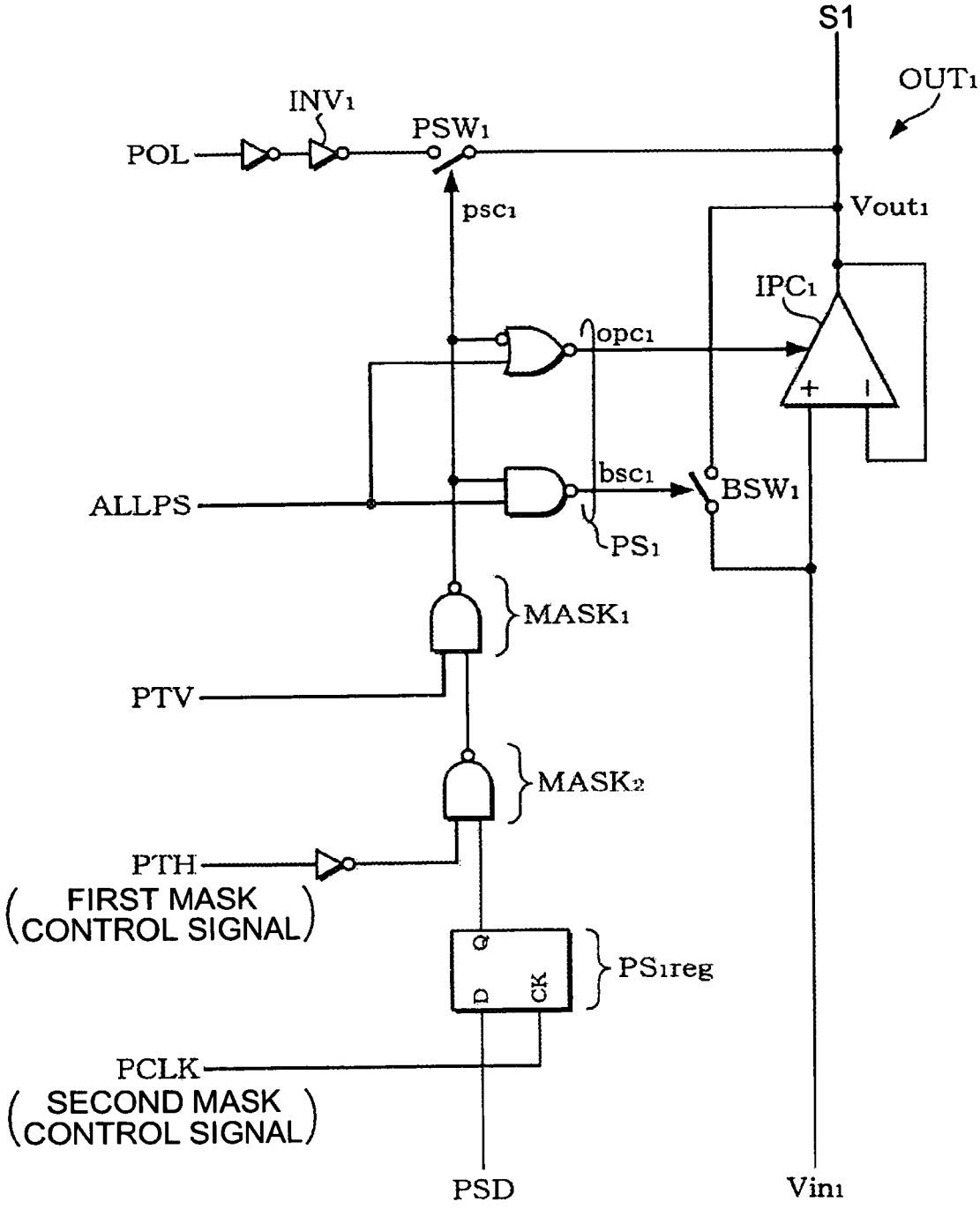
FIG. 7 shows an example configuration of the driving output circuit shown in FIG. 4.

FIG. 7 shows an example configuration of the driving output circuit $OUT_1$ shown in FIG. 4. Note that the driving output circuit $OUT_1$ does not necessarily include every circuit shown in FIG. 7. Part of the circuits shown in FIG. 7 may be in other circuit blocks than the driving output circuit $OUT_1$. While FIG. 7 shows an example configuration of the driving output circuit $OUT_1$, the same can be said for the other driving output circuits $OUT_2$ to $OUT_N$.

FIGS. 8A through 8D describe various signals that are input to the configuration shown in FIG. 7.

Referring to FIG. 7, the impedance conversion circuit $IPC_1$ included in the driving output circuit $OUT_1$ receives a grayscale voltage in accordance with display data as an input voltage $Vin_1$. The impedance conversion circuit $IPC_1$ drives a source line $S_1$ based on this input voltage $Vin_1$. The impedance conversion circuit $IPC_1$ is a voltage follower circuit.

The PS data holding circuit $PS_1$reg uses a D flip-flop. The PS data holding circuit $PS_1$reg receives the highest-order bit D5 out of the display data D0 to D5 for selecting the input voltage (grayscale voltage) $Vin_1$ as PS data PSD. The PS data holding circuit $PS_1$reg loads the PS data PSD at a rising of a clock signal PCLK. The PS data PSD specify "PS off" (release) for the H level and "PS on" for the L level as shown in FIG. 8A.

Coupled to the output of the impedance conversion circuit $IPC_1$ is an end of a partial switch (first switch circuit) $PSW_1$. Coupled to another end of the partial switch $PSW_1$ is the output of an inverter $INV_1$ to which an inverted signal of the polarity inversion signal POL is input. The inverter $INV_1$ outputs the system power supply voltage VDD or the system ground power supply voltage VSS as a non-display voltage based on this inverted signal of the polarity inversion signal POL. The system power supply voltage VDD or the system ground power supply voltage VSS is equal to a positive or negative polarity voltage of the counter electrode VCOM for polarity inversion. Therefore, when the partial switch $PSW_1$ is in the conducting state, a voltage equal to the voltage of the counter electrode VCOM is supplied to the source line $S_1$.

Also, the operational current of the impedance conversion circuit $IPC_1$ is suspended or restricted based on a power save control signal $opc_1$. When the operational current of the impedance conversion circuit $IPC_1$ is suspended or restricted, its output is set as a high impedance state. The power save control signal $opc_1$ and a control signal $psc_1$ of the partial switch $PSW_1$ are generated based on the PS data PSD loaded by the PS data holding circuit $PS_1$reg and a vertical partial control signal PTV (first mask control signal in a broad sense). The vertical partial control signal PTV is a signal variable in unit of a horizontal scan period. In other words, the vertical partial control signal PTV varies in synchronization with the start timing of a horizontal scan period. As shown in FIG. 8B, the vertical partial control signal PTV is in the H level during a vertical partial display period.

The control signal $psc_1$ is generated by making the PS data held by the PS data holding circuit $PS_1$reg based on the vertical partial control signal PTV in a first mask circuit $MASK_1$.

Based on this control signal $psc_1$, the operational current of the impedance conversion circuit $IPC_1$ is suspended or restricted to set its output as a high impedance state and set the partial switch $PSW_1$ to the conducting state (PS on control). Alternatively, based on the control signal $psc_1$, the impedance conversion circuit $IPC_1$ drives its output based on the input voltage $Vin_1$, and sets the partial switch $PSW_1$ to the non-conducting state (PS off control). In other words, the partial switch $PSW_1$ is set to the non-conducting state while the impedance conversion circuit $IPC_1$ operates, and the partial switch $PSW_1$ is set to the conducting state while the impedance conversion circuit $IPC_1$ is suspended.

Accordingly, during a regular display period specified by the vertical partial control signal PTV, the PS off control can be performed to the impedance conversion circuit $IPC_1$ and the partial switch $PSW_1$ irrespective of the PS data held by the PS data holding circuit $PS_1$reg. Also, during a vertical partial display period specified by the vertical partial control signal PTV, the PS on or PS off control can be performed to the impedance conversion circuit $IPC_1$ and the partial switch $PSW_1$ in accordance with the PS data held by the PS data holding circuit $PS_1$reg.

According to the present embodiment as shown in FIG. 7, it is possible to mask the PS data PSD with a second mask circuit $MASK_2$ based on a horizontal partial control signal PTH (second mask control signal), and then mask the output of the second mask circuit $MASK_2$ based on the vertical partial control signal PTV with the first mask circuit $MASK_1$. The horizontal partial control signal PTH is a signal variable in unit of a horizontal scan period. In other words, the horizontal partial control signal PTH varies in synchronization with the start timing of a horizontal scan period. As shown in FIG. 8C, the horizontal partial control signal PTH is in the H level during a horizontal partial display period.

During a regular display period specified by the horizontal partial control signal PTH, the PS on or PS off control is performed by the vertical partial control signal PTV as mentioned above. During a horizontal partial display period specified by the horizontal partial control signal PTH, the PS on control can be performed to the impedance conversion circuit $IPC_1$ and the partial switch $PSW_1$ irrespective of the PS data held by the PS data holding circuit $PS_1$reg.

With this driving output circuit $OUT_1$, currency is mainly consumed as the operational currency of the impedance conversion circuit $IPC_1$. Therefore, by reducing the power consumed by the impedance conversion circuit $IPC_1$, it is possible to reduce power consumption of the source driver 520 including the driving output circuit $OUT_1$. For this reason, a bypass switch $BSW_1$ (second switch circuit) for bypassing an input to and output from the impedance conversion circuit $IPC_1$ is preferably provided as shown in FIG. 7 according to the present embodiment. In this case, a control signal ALLPS as a driving period specifying signal is used to perform the switching control of the bypass switch $BSW_1$ and the operational suspension control of the impedance conversion circuit $IPC_1$. The control signal ALLPS is a signal variable within a horizontal scan period, and can specify each period as shown in FIG. 8D.

Figure 9:
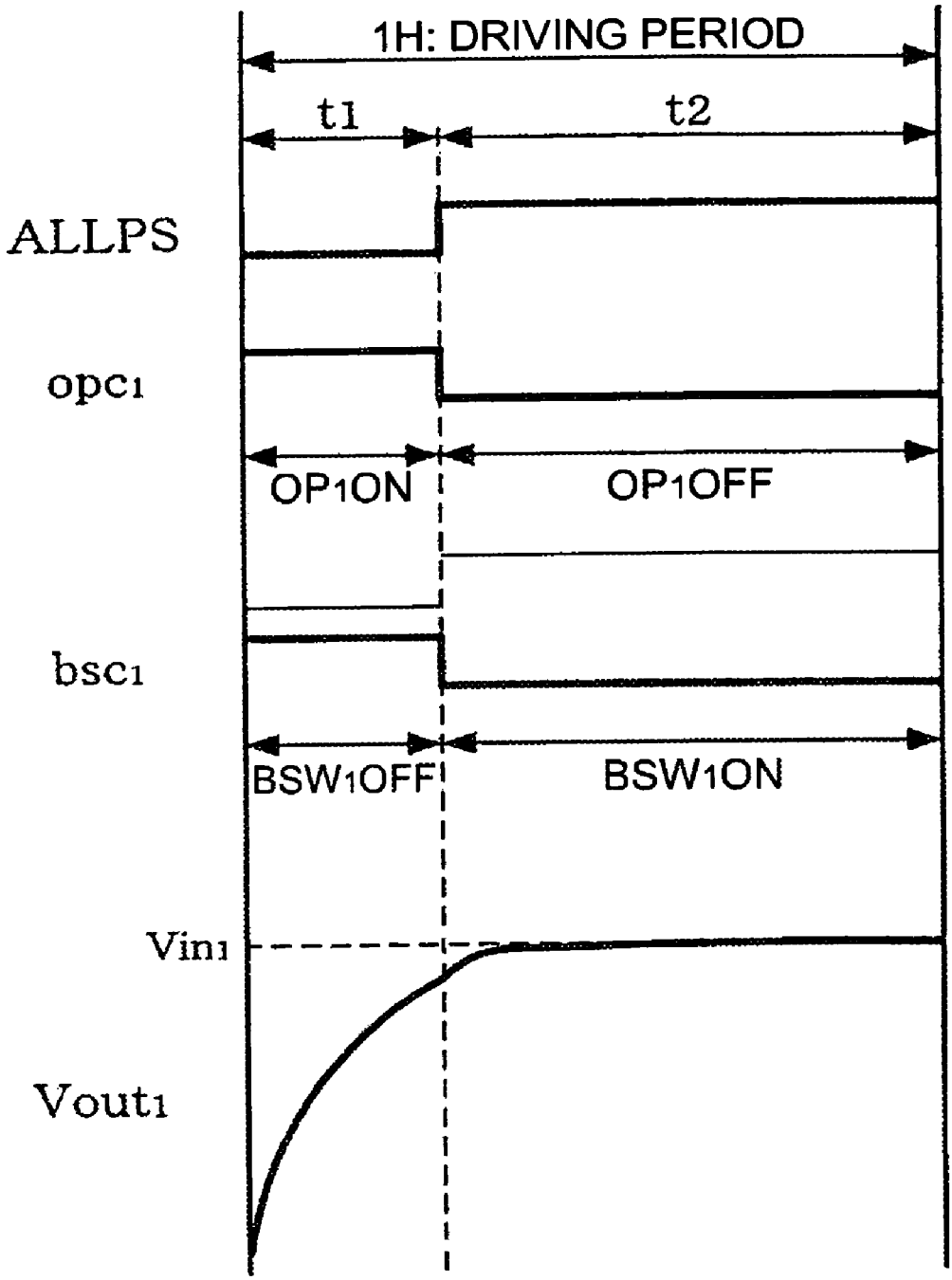
FIG. 9 shows a timing example of the switching control of a bypass switch and the operational suspension control of an impedance conversion circuit.

FIG. 9 shows a timing example of the switching control of the bypass switch $BSW_1$ and the operational suspension control of the impedance conversion circuit $IPC_1$.

The control signal ALLPS specifies a first period t1 within a horizontal scan period (1H or a driving period in a broad sense) and a second period t2 following the first period t1 within this horizontal scan period. During the first period t1, a bypass control signal $bsc_1$ is generated such that the bypass switch $BSW_1$ is set to the non-conducting state. Also, the impedance conversion circuit $IPC_1$ is turned on to generate the power save control signal $opc_1$ such that the impedance conversion circuit $IPC_1$ will drive its output based on the input voltage $Vin_1$.

During the second period t2, the bypass control signal $bsc_1$ is generated such that the bypass switch $BSW_1$ is set to the conducting state. Also, the operational current of the impedance conversion circuit $IPC_1$ is suspended or restricted to generate the power save control signal $opc_1$ such that the output of the impedance conversion circuit $IPC_1$ will be set as a high impedance state.

As mentioned above, the bypass control signal $bsc_1$ for the switching control of the bypass switch $BSW_1$ is generated based on the control signal ALLPS and the control signal $psc_1$. The power save control signal $opc_1$ is also generated based on the control signal ALLPS and the control signal $psc_1$.

The above-mentioned control makes it possible to drive the source line $S_1$ with high driving capability of the impedance conversion circuit $IPC_1$ during the first period t1, and thereby approaching a target voltage in a short period of time. During the second period t2, the input voltage $Vin_1$ is directly supplied to the source line $S_1$, and thereby achieving the target voltage. Thus the operation period of the impedance conversion circuit $IPC_1$, which consumes a great amount of current, can be reduced to minimum, and thereby largely reducing current consumption.

Note that if the control signal $psc_1$ suspends or restricts the operational current of the impedance conversion circuit $IPC_1$, the power save control signal $opc_1$ and bypass control signal $bsc_1$ turn the impedance conversion circuit $IPC_1$ off and the bypass switch $BSW_1$ off.

The vertical partial control signal PTV, the horizontal partial control signal PTH, the polarity inversion signal POL, and the control signal ALLPS are commonly supplied to each driving output circuit of the driving output circuits $OUT_1$ to $OUT_N$.

Figure 10:
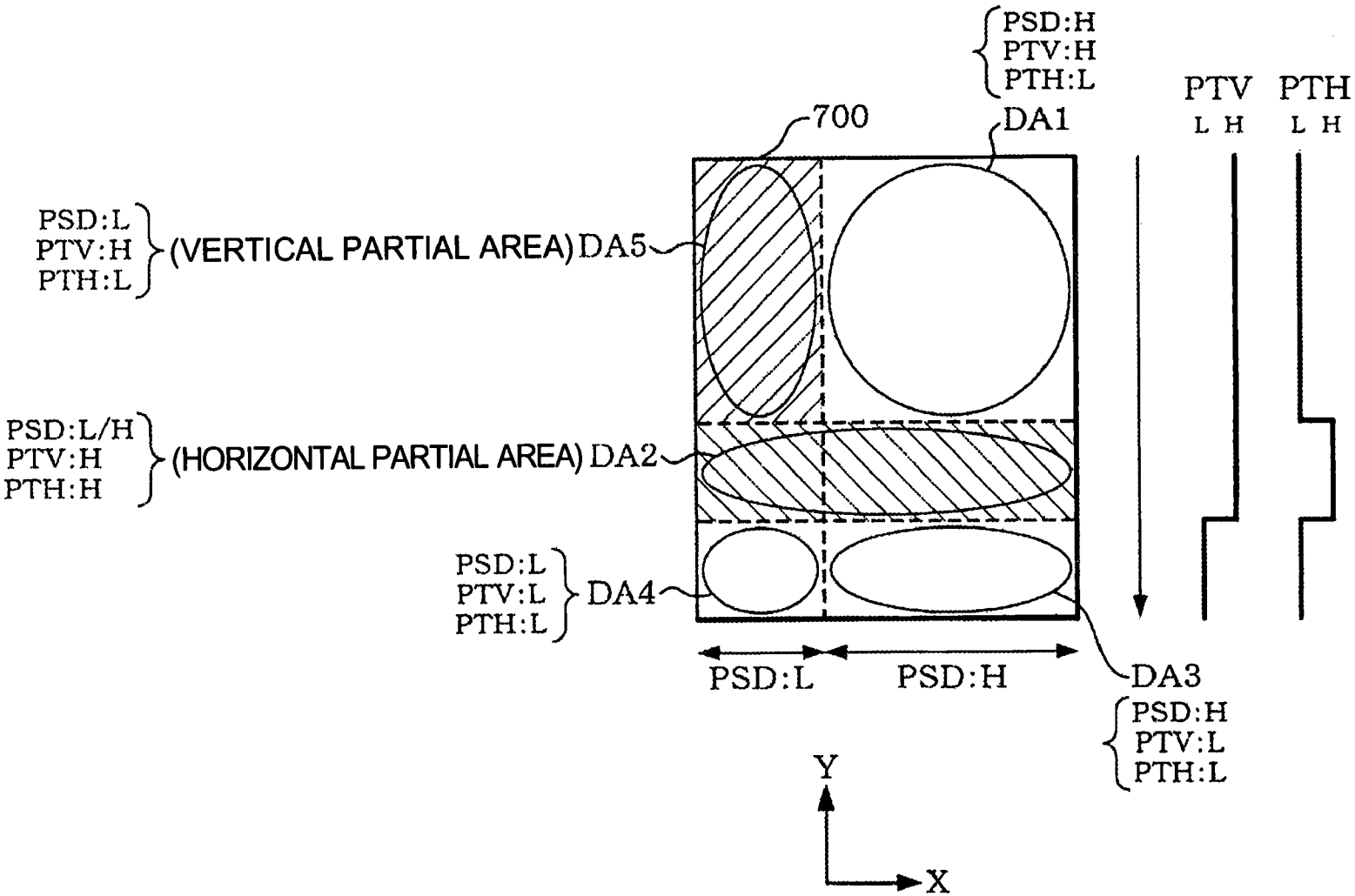
FIG. 10 illustrates a partial display according to the present embodiment.

FIG. 10 illustrates a partial display according to the present embodiment.

FIG. 10 schematically shows each area set in a displayable area 700 of the liquid crystal panel 512 shown in FIG. 1.

The displayable area 700 is divided into two areas in the X direction shown in FIG. 10. These two areas are separated by a source line. One area sets a PS data holding circuit provided corresponding to each impedance conversion circuit for driving the source line (or impedance conversion circuits corresponding to a plurality of dots making up a pixel) as the L level, and another sets it as the H level.

Accordingly, in the circuit shown in FIG. 7, in a display area having a scan line with the vertical partial control signal PTV at the H level and the horizontal partial control signal PTH at the L level within a vertical scan period, an area DA5 whose PS data holding circuit is set as the L level becomes a vertical partial area, while another area DA1 whose PS data holding circuit is set as the H level becomes a regular display area. In other words, the partial switch $PSW_1$ becomes the conducting state in the area DA5, and the same voltage as that of the counter electrode VCOM is supplied to the source line $S_1$ in accordance with the polarity inversion timing. Meanwhile, the impedance conversion circuit $IPC_1$ and the bypass switch $BSW_1$ drive the source line $S_1$ based on the input voltage $Vin_1$ in the area DA1. In this case, since the operational current of the impedance conversion circuit driving the vertical partial area is suspended or restricted, power consumption can be reduced.

An area DA2 having a scan line with the vertical partial control signal PTV at the H level and the horizontal partial control signal PTH at the H level becomes a horizontal partial area irrespective of the set value of its PS data holding circuit. In other words, the partial switch $PSW_1$ becomes the conducting state in the area DA2, and the same voltage as that of the counter electrode VCOM is supplied to the source line $S_1$ in accordance with the polarity inversion timing. In this case, since the operational current of the impedance conversion circuit is suspended or restricted during the scan period of the horizontal partial area, power consumption can be reduced.

Of other display areas having scan lines with the vertical partial control signal PTV at the L level and the horizontal partial control signal PTH at the L level, an area DA4 whose PS data holding circuit is set at the L level and another area DA3 whose PS data holding circuit is set at the H level both become a regular display area. Thus in the areas DA3 and DA4, the impedance conversion circuit $IPC_1$ and the bypass switch $BSW_1$ drive the source line $S_1$ based on the input voltage $Vin_1$.

Figure 11:
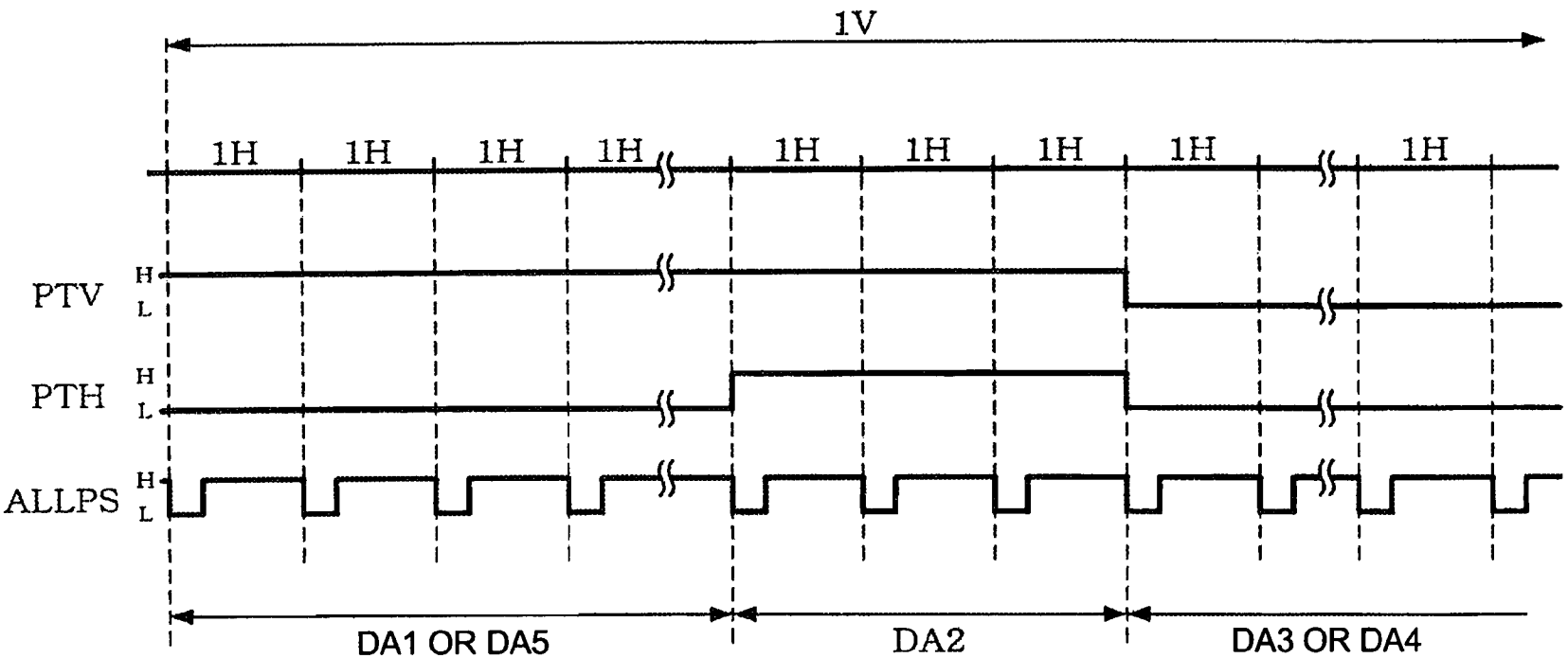
FIG. 11 shows an operation timing example of the driving output circuit shown in FIG. 7.

FIG. 11 shows an operation timing example of the driving output circuit $OUT_1$ shown in FIG. 7.

Referring to FIG. 11, a scan line with the vertical partial control signal PTV at the H level and the horizontal partial control signal PTH at the L level defines the area DA1 or DA5 based on the PS data set in the PS data holding circuit. A scan line with both the vertical partial control signal PTV and the horizontal partial control signal PTH at the H level defines the area DA2 irrespective of the PS data set in the PS data holding circuit. A scan line with both the vertical partial control signal PTV and the horizontal partial control signal PTH at the L level defines a regular display area (the area DA3 or DA4) irrespective of the PS data set in the PS data holding circuit.

Figure 12:
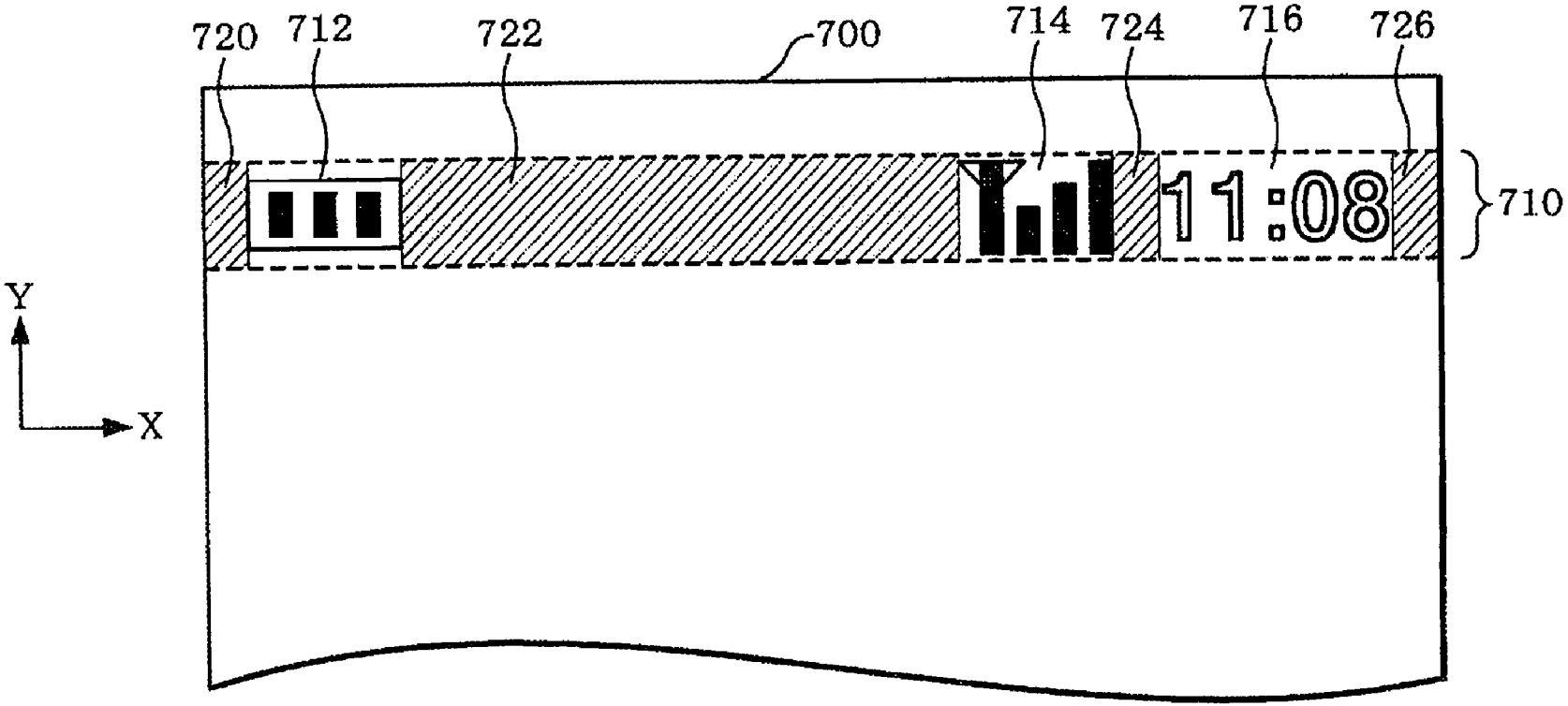
FIG. 12 illustrates a partial display effect according to the present embodiment.

FIG. 12 illustrates a partial display effect according to the present embodiment.

FIG. 12 shows that an image is displayed as a standby display of a cellular phone in part of the displayable area 700 of the liquid crystal panel 512 that is incorporated in this cellular phone that is an electronic apparatus. In the displayable area 700, a display area 710 is separated and defined by a gate line. The display area 710 displays a remaining battery power indicator 712, a radio field strength indicator 714, and a clock 716 of the cellular phone.

Related art source drivers consume unnecessary power, since they drive source lines in areas 720, 722, 724, 726 in addition to the remaining battery power indicator 712, the radio field strength indicator 714, and the clock 716. The present embodiment enables detailed setting of PS data, and there is no need to provide extra control over the gate driver in scanning the areas 720, 722, 724, 726 without driving their source lines. Therefore, it is possible to further reduce power consumption.

FIGS. 13A through 13D illustrate another example of partial displays according to the present embodiment.

Figure 13A:
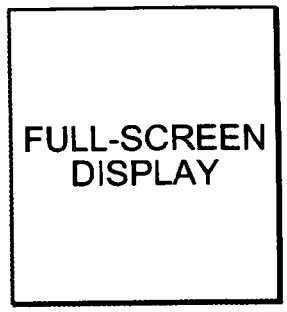
FIGS. 13A through 13D illustrate another example of partial displays according to the present embodiment.

In the present embodiment, PS data are set in each PS data holding circuit during the process of initialization, for example. The vertical partial control signal PTV and the horizontal partial control signal PTH set the whole displayable area as a regular display area as shown in FIG. 13A irrespective of PS data. By changing the vertical partial control signal PTV to reduce power consumption, it is possible to provide a vertical partial display as shown in FIG. 13B.

Figure 13B:
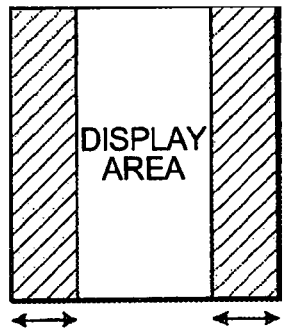
Figure 13C:
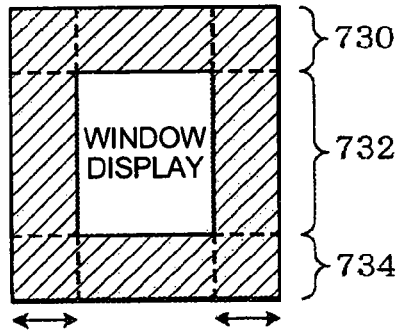
Figure 13D:
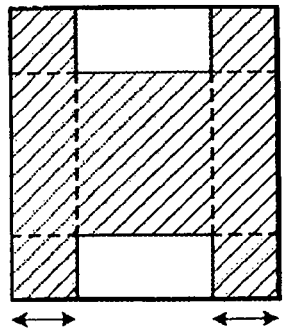

By setting the horizontal partial control signal PTH for the scan lines of areas 730 and 734 at the H level and the horizontal partial control signal PTH for the scan lines of another area 732 at the L level with the state shown in FIG. 13B, it is possible to provide a window display as shown in FIG. 13C. It is also possible to provide a display as shown in FIG. 13D in the same manner.

Detailed partial displays can be achieved as mentioned above, and power consumption can be further reduced.

2.2 Setting of PS Data

Figure 14:
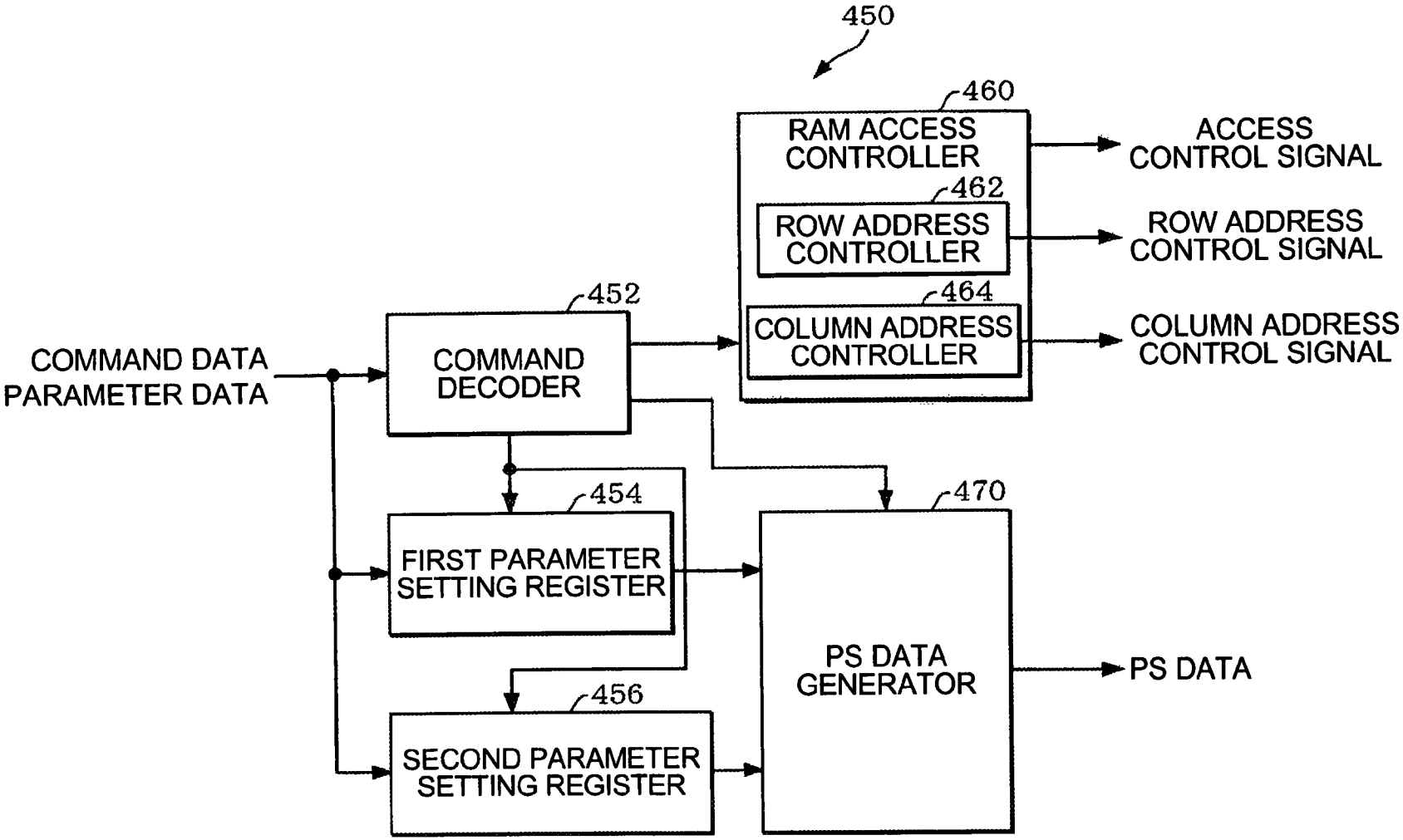
FIG. 14 is a block diagram showing an example circuit configuration for setting PS data according to the present embodiment.

FIG. 14 is a block diagram of an example configuration of a PS data setting circuit for setting PS data according to the present embodiment.

This PS data setting circuit 450 is included in, for example, the control logic 624 or the driving circuit 650 shown in FIG. 2.

The PS data setting circuit 450 includes a command decoder 452, a first parameter setting register 454, a second parameter setting register 456, a RAM access controller 460, and a PS data generator 470. The RAM access controller 460 includes a row address controller 462 and a column address controller 464. The row address controller 462 outputs a row address control signal for generating a row address of the display data RAM 600 to the row address circuit 602. The column address controller 464 outputs a column address control signal for generating a column address of the display data RAM 600 to the column address circuit 604.

The command decoder 452 decodes control commands from a host. Such commands from a host are input via the system interface circuit 620 shown in FIG. 2. If one of these commands is defined as a first setting command that has been set in advance for specifying the setting of PS data according to the present embodiment as a control command, this first setting command has two pieces of parameter data. These two pieces of parameter data specify which impedance conversion circuit is set enable.

On judging a control command to be the first setting command, the command decoder 452 sets the two pieces of parameter data, input after the first setting command from the host, in the first parameter setting register 454 and the second parameter setting register 456. The command decoder 452 then directs the RAM access controller 460 to access the display data RAM 600 and also directs the PS data generator 470 to generate PS data.

The PS data generator 470 generates PS data based on the set values in the first parameter setting register 454 and the second parameter setting resister 456. For example, when setting PS data, for sequentially from the impedance conversion circuit $IPC_1$ to the impedance conversion circuit $IPC_N$, PS data remain "0" until reaching an impedance conversion circuit whose set value corresponds to the set value of the first parameter setting register 454. Subsequently, PS data remain "1" until reaching an impedance conversion circuit whose set value corresponds to the set value of the second parameter setting register 456. After reaching the impedance conversion circuit whose set value corresponds to the set value of the second parameter setting register 456, PS data become "0".

The RAM access controller 460 outputs an access control signal, a row address control signal, and a column address control signal for writing PS data corresponding to impedance conversion circuits and an access control signal and a row address control signal for reading PS data corresponding to impedance conversion circuits.

Figure 15:
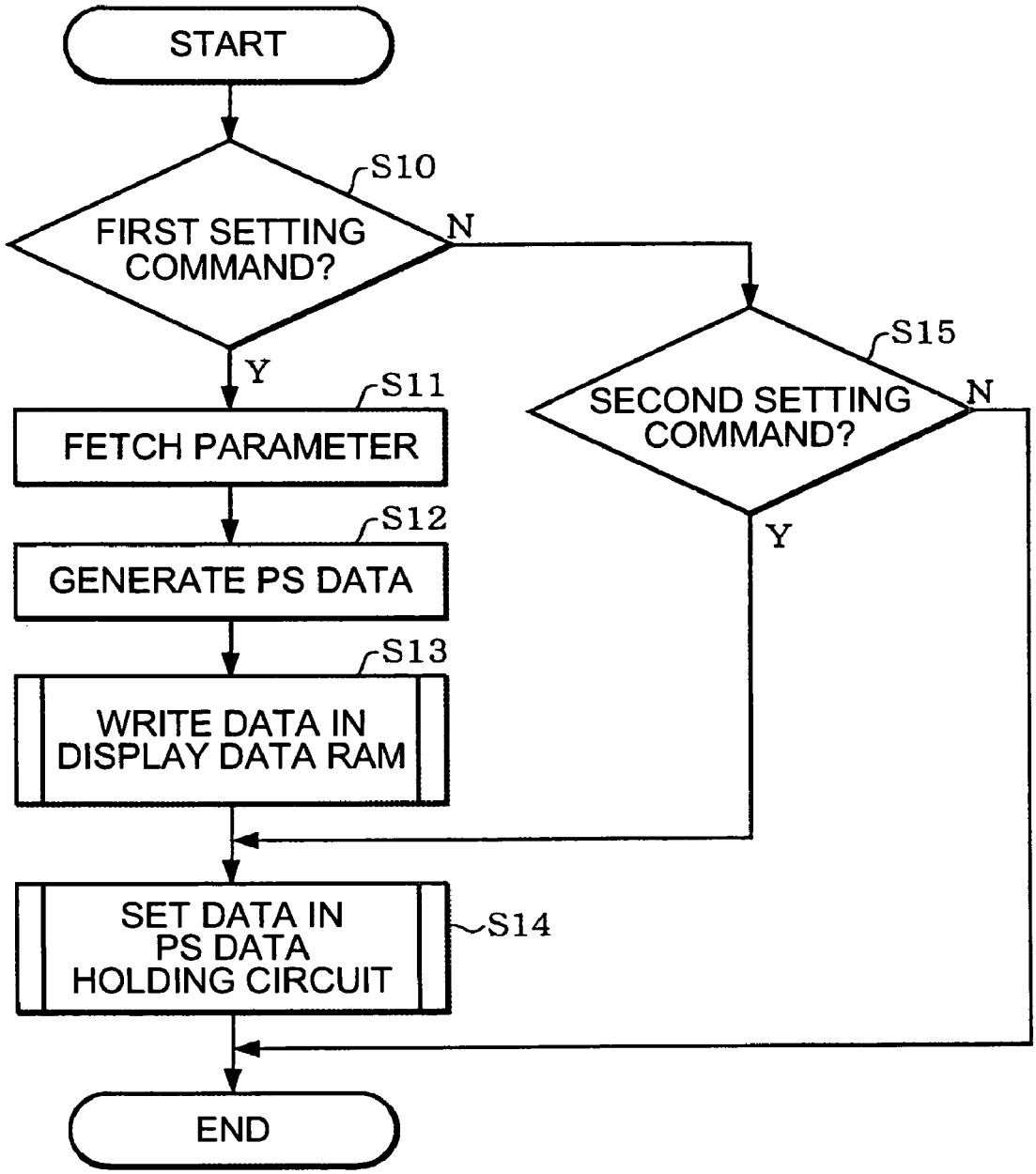
FIG. 15 is a flowchart illustrating an operation example of the circuit shown in FIG. 14.

FIG. 15 is a flowchart illustrating an operation example of the PS data setting circuit shown in FIG. 14.

The command decoder 452 decodes a control command from the host. If it judges the command to be the first setting command (Step S10: Y), the command decoder fetches two pieces of parameter data, input after the first setting command from the host, into the first parameter setting register 454 and the second parameter setting register 456 (Step S11).

The command decoder 452 then directs the PS data generator 470 to generate PS data. The PS data generator 470 generates PS data based on the set values in the first parameter setting register 454 and the second parameter setting resister 456 as mentioned above, for example (Step S12).

The command decoder 452 then directs the RAM access controller 460 to write the PS data in the display data RAM 600. The PS data are thus written in the display data RAM 600 (Step S13).

Subsequently, the command decoder 452 directs the RAM access controller 460 to read the PS data in the display data RAM 600 that have been written in Step S13, and sets the PS data read from the display data RAM 600 in each PS data holding circuit (Step S14), which completes this series of processing (END).

If a control command from the host is judged not to be the first setting command in Step S10 (Step S10: N), the command decoder 452 judges whether the control command is the second setting command defined in advance as a control command for setting the PS data of the display data RAM 600 in the first to N-th PS data holding circuits $PS_1$reg to $PS_N$reg (Step S15).

If the command decoder 452 judges the command to be the second setting command (Step S15: Y), the process proceeds to Step S14. If the command decoder 452 judges the command not to be the second setting command (Step S15: N), the process then terminates (END).

Note that the present embodiment makes it possible to set PS data by the same route as display data from the host, for example, and thereby the host can write PS data in the display data RAM 600 in the same manner as display data. Here, the host inputs the second setting command, and thus the highest-order bit data on the 340th line in the display data RAM 600 are judged to be the PS data. The data are thus loaded as PS data in the first to N-th PS data holding circuits $PS_1$reg to $PS_N$reg.

Figure 16:
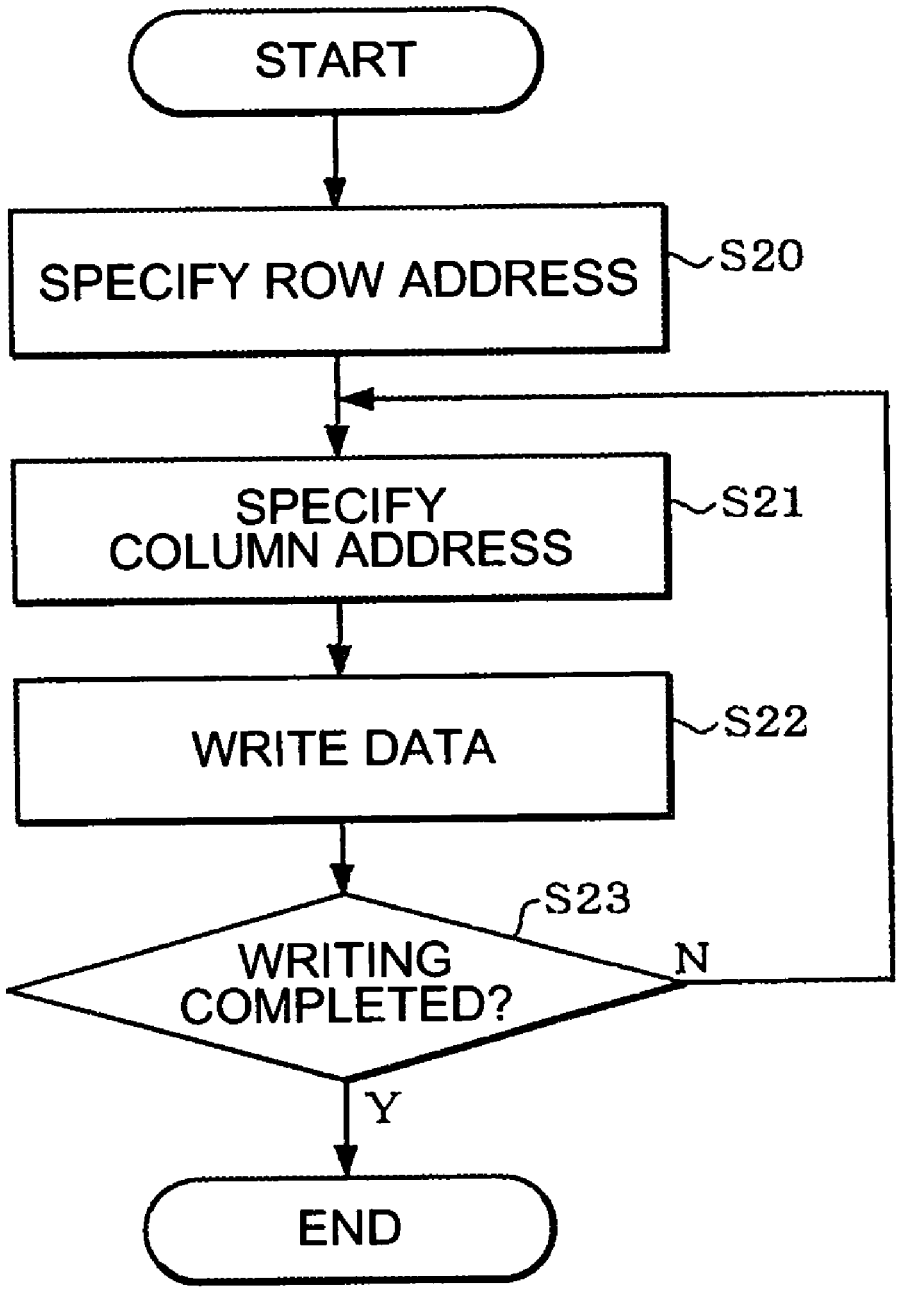
FIG. 16 is a flowchart illustrating the process shown in FIG. 15.

FIG. 16 is a flowchart illustrating the process of Step S13 of FIG. 15.

Upon being directed by the command decoder 452 to write PS data, the RAM access controller 460 outputs a row address control signal in the row address controller 462. In response to this, the row address circuit 602 generates a row address for specifying an area to store display data on the 340th line shown in FIG. 4 (Step S20).

Subsequently, the RAM access controller 460 outputs a column address control signal in the column address controller 464. In response to this, the column address circuit 604 generates a column address for specifying an area to store display data of each column on the 340th line shown in FIG. 4 (Step S21). The RAM access controller 460 then outputs an access control signal for writing, and thereby controlling writing of PS data in a storage area specified by the row address in Step S20 and the column address in Step S21 (Step S22).

If writing of not all the PS data generated by the PS data generator 470 is completed (Step S23: N), the process returns to Step S21 to output a column address control signal for renewing a column address.

If writing of the PS data is completed (Step S23: Y), the process then terminates (END).

Figure 17:
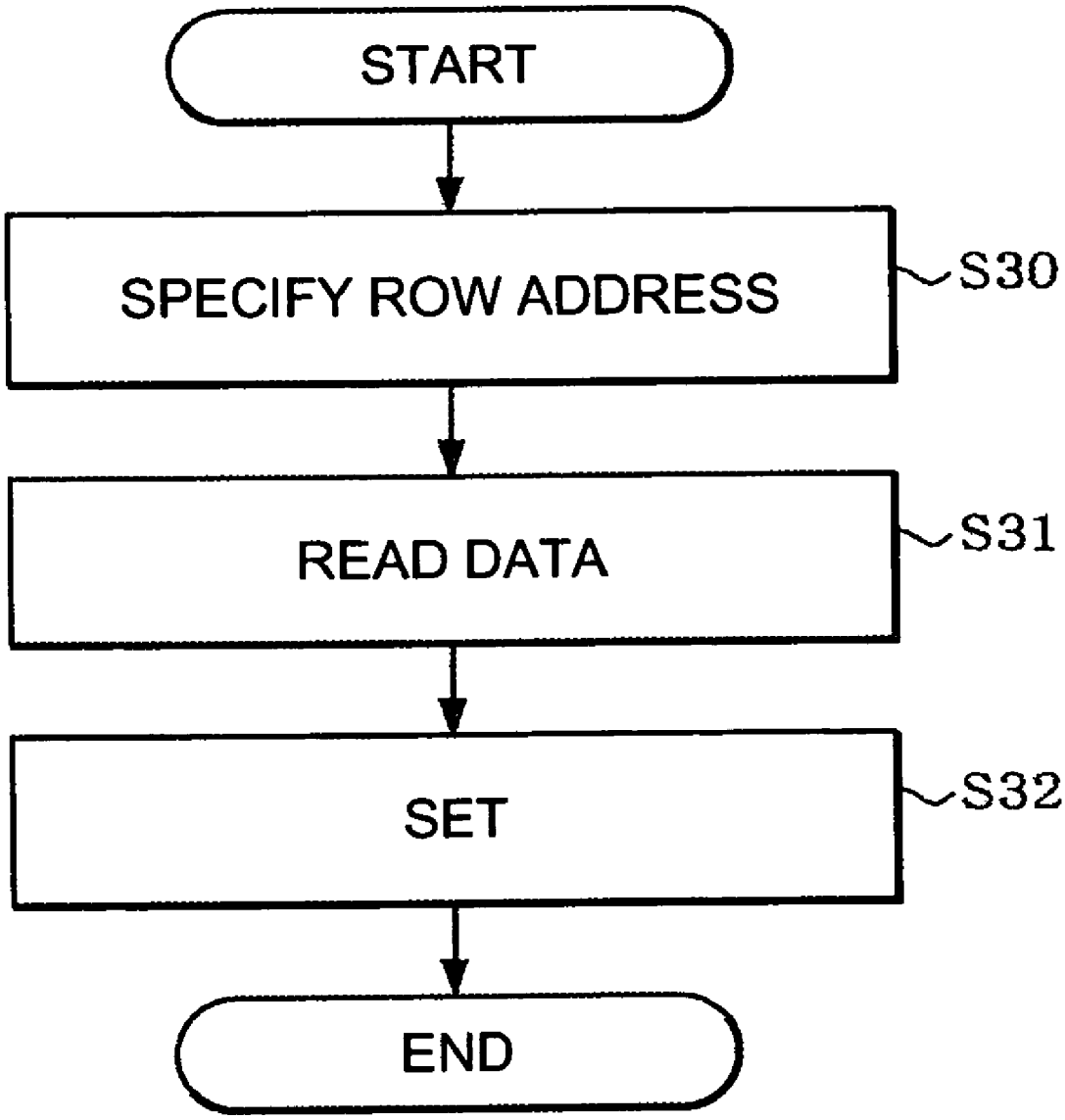
FIG. 17 is a flowchart illustrating the process shown in FIG. 15.

FIG. 17 is a flowchart illustrating the process of Step S14 of FIG. 15.

Upon being directed by the command decoder 452 to set PS data, the RAM access controller 460 outputs a row address control signal in the row address controller 462. In response to this, the row address circuit 602 generates a row address for specifying an area to store display data on the 340th line shown in FIG. 4 (Step S30).

Subsequently, the RAM access controller 460 outputs an access control signal for reading, and thereby controlling reading of PS data in a storage area specified by the row address in Step S30 (Step S31).

Lastly, the command decoder 452 outputs a direction signal for loading the PS data read in Step S31 in the first to N-th PS data holding circuits $PS_1$reg to $PS_N$reg (Step S32), and then the process terminates (END).

While the row address is specified in Step S30, the line address circuit 610 shown in FIG. 2 may instead generate a line address of the 340th line. In this case, for example, the RAM access controller 460 shown in FIG. 14 includes a line address controller that outputs a line address control signal for generating the line address of the 340th line to the line address circuit 610.

While PS data are stored temporarily in the display data RAM 600 and then set in the PS data holding circuits in the present embodiment, the invention is not limited to this. For example, the PS data holding circuits may be coupled sequentially to form a shift register, so that PS data are directly set in each PS data holding circuit through shift operations.

2.3 Impedance Conversion Circuit

The impedance conversion circuit according to the present embodiment includes a voltage follower circuit that has a lower phase margin with load unconnected to its output than with load connected to its output. This impedance conversion circuit will now be described in detail.

Figure 18:
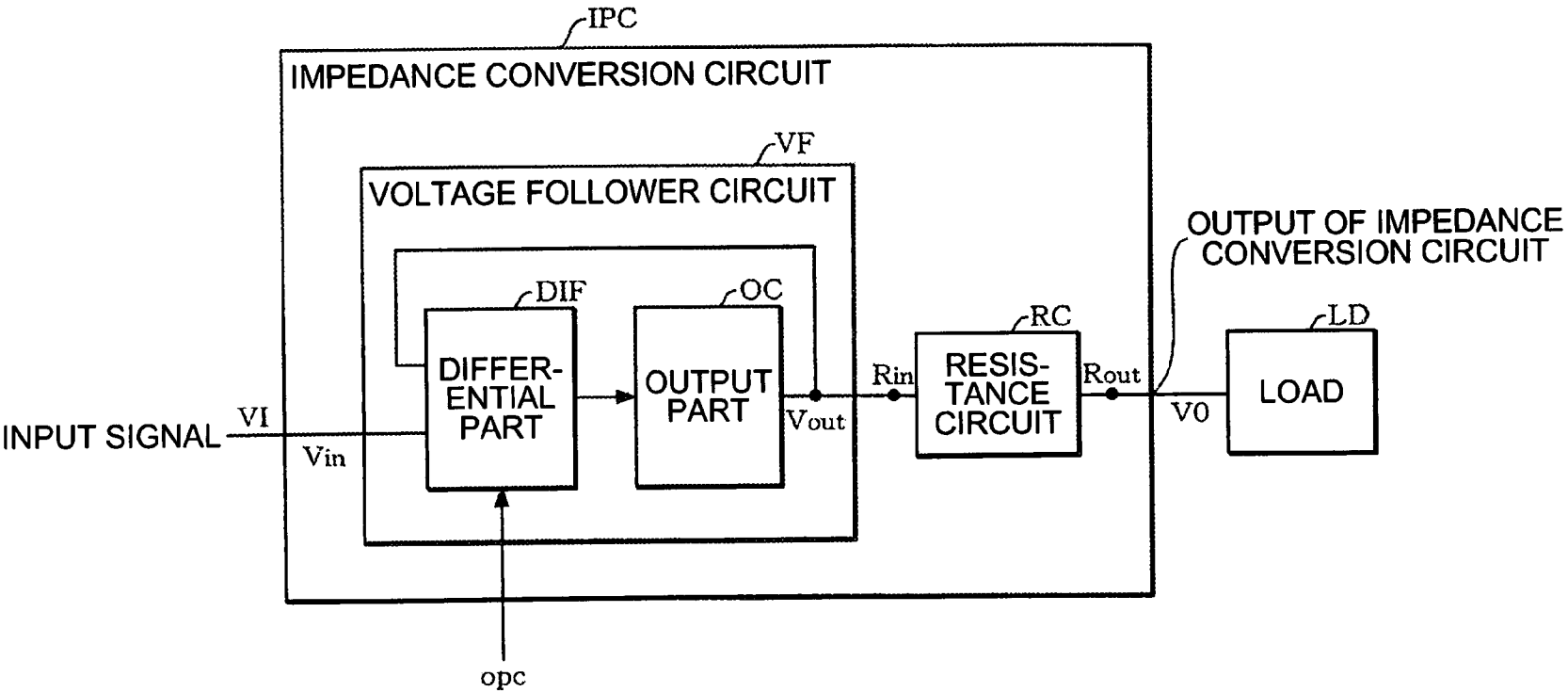
FIG. 18 is a block diagram showing an example configuration of the impedance conversion circuit according to the present embodiment.

FIG. 18 is a block diagram showing an example configuration of the impedance conversion circuit according to the present embodiment. This impedance conversion circuit shown in FIG. 18 is included in each driving output circuit shown in FIGS. 4 and 5.

This impedance conversion circuit IPC includes a voltage follower circuit VF and a resistance circuit RC, and drives a capacitive load LD. The voltage follower circuit VF provides impedance conversion of an input signal Vin (VI). The resistance circuit RC is serially coupled between outputs of the voltage follower circuit VF and the impedance conversion circuit IPC. The voltage follower circuit VF includes a differential part DIF for amplifying a differential between the input signal Vin (VI) and an output signal Vout of the voltage follower circuit VF, and an output part OC for outputting the output signal Vout based on an output from the differential part DIF. Here, the operational current of the differential part DIF is suspended or restricted based on a power save control signal opc (corresponding to the power save control signal $opc_1$ in FIG. 7).

The impedance conversion circuit IPC drives the load LD connected to the output of the impedance conversion circuit via the resistance circuit RC. In this manner, the resistance circuit RC is generally provided to the output of the voltage follower circuit VF used for converting infinitely large input impedance into smaller impedance. The load LD is driven via this resistance circuit RC. This structure makes it possible to adjust a slew rate (reaction rate) of the output part OC with a resistance value of the resistance circuit RC and a load capacity of the load LD. Accordingly, there is no need to provide the voltage follower circuit VF (impedance conversion circuit IPC) with a capacitor for phase compensation to prevent oscillation determined by the relation between the slew rate at an output of the differential part DIF and the slew rate at an output of the output part OC which returns its output to the differential part DIF.

FIG. 19 illustrates the relation between the slew rate at the outputs of the differential part DIF and the output part OC and oscillation. This chart focuses on the relation between the slew rate at the outputs of the differential part DIF and the output part OC and phase margins.

The impedance conversion circuit IPC (voltage follower circuit VF) oscillates when its phase margin becomes 0. The higher the phase margin, the more difficult it becomes to oscillate, and vice versa. The phase margin is determined by the slew rate at the output of the differential part DIF (the reaction rate of the differential part DIF) and the slew rate at the output of the output part OC (reaction rate of the output part OC) in order for the voltage follower circuit VF to return the output of the output part OC to the input of the differential part DIF.

The slew rate at the output of the differential part DIF is an amount of change per unit time at the output of the differential part DIF with respect to a step change at the input to the differential part DIF. Referring to FIG. 18, for example, this slew rate is equivalent to an amount of change per unit time at the output of the differential part DIF caused by amplifying of a differential between the output signal Vout returned from the output of the output part OC and the input signal Vin (VI) in response to inputting of the input signal Vin (VI).

The slew rate at the output of the differential part DIF can be replaced with the reaction rate of the differential part DIF. The reaction rate of the differential part DIF corresponds to time required for the output of the differential part DIF to change relative to a change at the input to the differential part DIF. Referring to FIG. 18, for example, this reaction rate corresponds to time required, after the input signal Vin (VI) is input, to amplify a differential between the output signal Vout returned from the output of the output part OC and the input signal Vin (VI), and to change the output of the differential part DIF. The larger the slew rate is, the faster the reaction rate becomes, and vice versa. This reaction rate of the differential part DIF is determined by the current value of the current source of the differential part DIF, for example.

The slew rate at the output of the output part OC is equivalent to an amount of change per unit time at the output relative to a step change at the input to the output part OC. Referring to FIG. 18, for example, this slew rate corresponds to time required, after the output of the differential part DIF changes, to change the output signal Vout in line with a change at the output of the differential part DIF.

The slew rate at the output of the output part OC can be replaced with the reaction rate of the output part OC. The reaction rate of the output part OC corresponds to time required for the output of the output part OC to change relative to a change at the input to the output part OC. Referring to FIG. 18, for example, this reaction rate corresponds to time required, after the output of the differential part DIF changes, to change the output signal Vout in line with a change at the output of the differential part DIF. This reaction rate of the output part OC is determined by the currency driving capability of the output part OC and a load connected to the output of the output part OC, for example.

Figure 20:
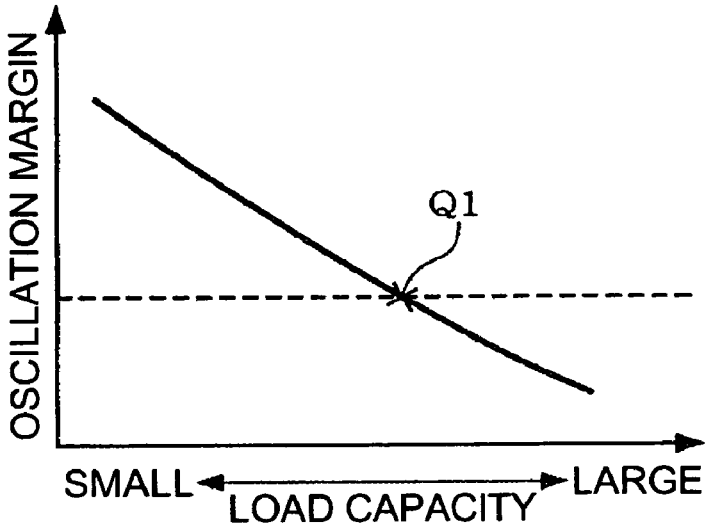
FIG. 20 shows an example of changes in oscillation margins with respect to load capacity.

As for the stability of the output signal Vout, as the slew rate at the output of the differential part DIF becomes closer to the slew rate at the output of the output part OC, it becomes easier to oscillate and phase margin decreases. Consequently, if the slew rate at the output of the differential part DIF is smaller than the slew rate at the output of the output part OC (i.e. the reaction rate of the differential part DIF is lower than that of the output part OC), the phase margin is high with no load LD connected, and the phase margin becomes higher with load connected that decreases the slew rate at the output of the output part OC. In other words, as shown in FIG. 20, the larger the load capacity of the load LD, the lower the oscillation margin corresponding to the phase margin, and resulting in oscillation at the point Q1. In this case, if there is a sufficient degree of oscillation margin with no load connected, it is possible to prevent oscillation with no load connected by taking the load capacity into consideration.

Figure 21:
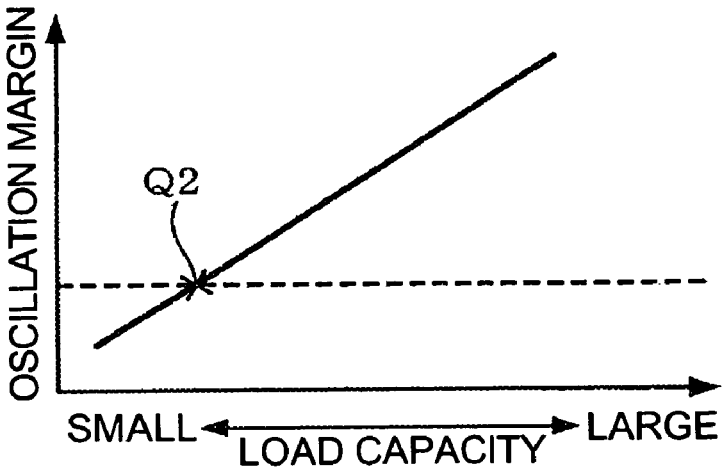
FIG. 21 shows another example of changes in oscillation margins with respect to load capacity.

On the contrary, if the slew rate at the output of the differential part DIF is larger than the slew rate at the output of the output part OC (i.e. the reaction rate of the differential part DIF is higher than that of the output part OC), the phase margin is low with no load LD connected, and the phase margin becomes higher with load connected that decreases the slew rate at the output of the output part OC (i.e. the reaction rate of the output part OC becomes lower). If the slew rate at the output of the differential part DIF is the same as or identical to the slew rate at the output of the output part OC, that is, if the reaction rate of the differential part DIF is the same as or almost identical to the reaction rate of the outlet part OC, the phase margin is low with no load connected, and the phase margin becomes higher with load connected that decreases the slew rate at the output of the outlet part OC. Consequently, as shown in FIG. 21, the larger the load capacity of the load LD, the higher the oscillation margin, and resulting in oscillation at the point Q2. However, oscillation when load is connected can be surely prevented by making the oscillation margin when no load is connected higher than the point Q2. The voltage follower circuit VF according to the present embodiment has a lower phase margin when its output is provided with no load, and the larger the load, the higher the oscillation margin.

2.3.1 Resistance Circuit

Figure 22A:
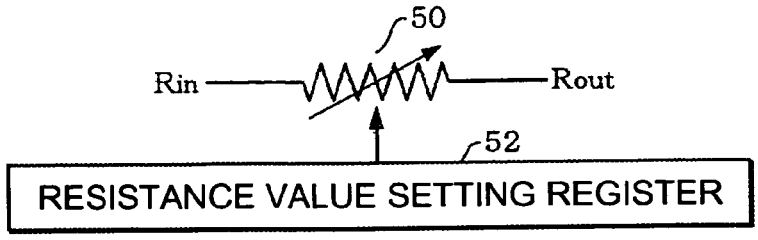
FIGS. 22A through 22C show example configurations of resistance circuits.
Figure 22B:
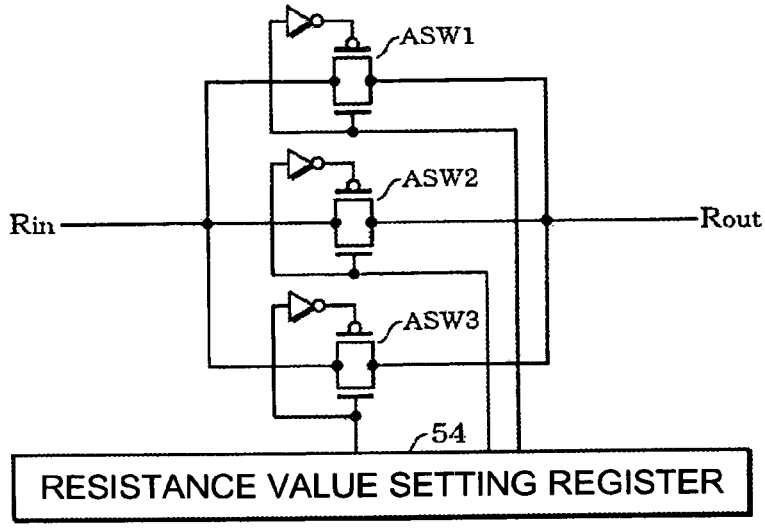
Figure 22C:
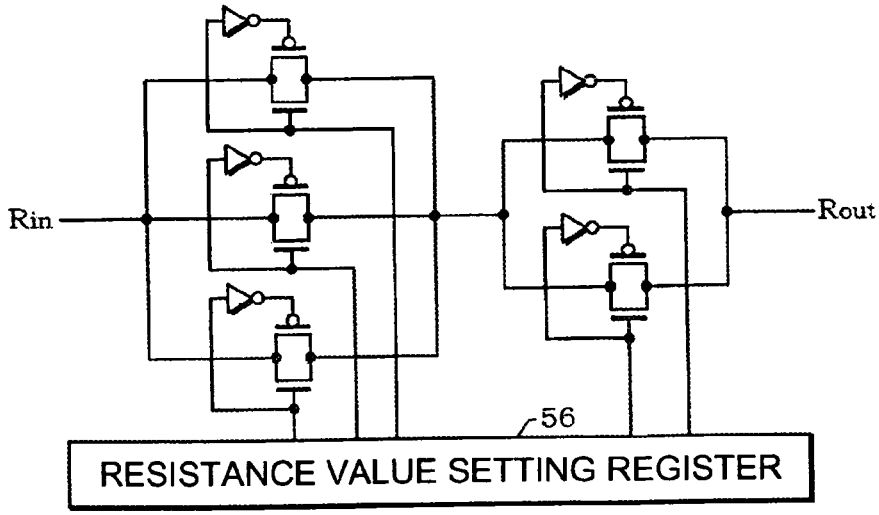

FIGS. 22A through 22C show example configurations of a resistance circuit RC.

The resistance circuit RC may include a variable resistance element 50 as shown in FIG. 22 A. In this case, the slew rate at the output of the output part OC (i.e. the reaction rate of the outlet part OC) can be adjusted with the resistance value of the resistance circuit RC and the load capacity of the load LD. Here, a resistance value setting register 52 is preferably provided whose value is set by the controller 540 or host. Also, it is preferable to set a resistance value of the variable resistance element 50 depending on the set value of the resistance value setting register 52.

The resistance circuit RC may include an analog switching element ASW as shown in FIG. 22B. The analog switching element ASW is coupled to the source and drain of a pMOS transistor and the source and drain of an nNMOS transistor. By turning the pMOS and nMOS transistors on at the same time, a resistance value of the resistance circuit RC is determined by on-resistance of the pMOS and nMOS transistors.

Specifically, the resistance circuit RC may include a plurality of analog switching elements coupled in parallel. While three analog switching elements ASW1 to ASW3 are coupled in parallel in FIG. 22B, two or more than three of them may be coupled in parallel. It is preferable to provide the respective analog switching elements with different resistance values by providing different transistor sizes to form the respective analog switching elements in FIG. 22B. This configuration makes it possible to increase variations of resistance values that the resistance circuit RC can provide by turning at least one of the three analog switching elements ASW1 to ASW3 on.

Here, a resistance value setting register 54 is preferably provided whose value is set by the controller 540 or host. Also, it is preferable to set on/off of the analog switching elements ASW1 to ASW3 depending on the set value of the resistance value setting register 54.

Alternatively, a plurality of units each of which includes a plurality of analog switching elements coupled in parallel may be coupled in series as shown in FIG. 22C. In this case, a resistance value setting register 56 is preferably provided whose value is set by the controller 540 or host. Also, it is preferable to set on/off of the analog switching elements depending on the set value of the resistance value setting register 56.

When using the resistance circuit RC as shown in FIGS. 22A through 22C, it is preferable that a resistance value of the resistance circuit RC is set small as the capacity of the load LD becomes larger, and the value is set large as the capacity of the load LD becomes smaller. This is because charging time for the load is determined by multiplying the resistance value of the load circuit RC by the load capacity, and thereby a gain decreases as the oscillation margin exceeds a certain level.

2.3.2 Voltage Follower Circuit

In the present embodiment, the stability of a circuit can be determined by the relationship between the slew rate at the output of the differential part DIF and the slew rate at the output of the output part OC as mentioned above. Referring to FIG. 19, it is preferable that the slew rate at the output of the differential part DIF is the same as (equal to) or larger than the slew rate at the output of the output part OC.

By employing the voltage follower circuit having the configuration mentioned below, it is possible to increase the slew rate at the output of the differential part DIF, while a capacitor for phase compensation is not required.

Figure 23:
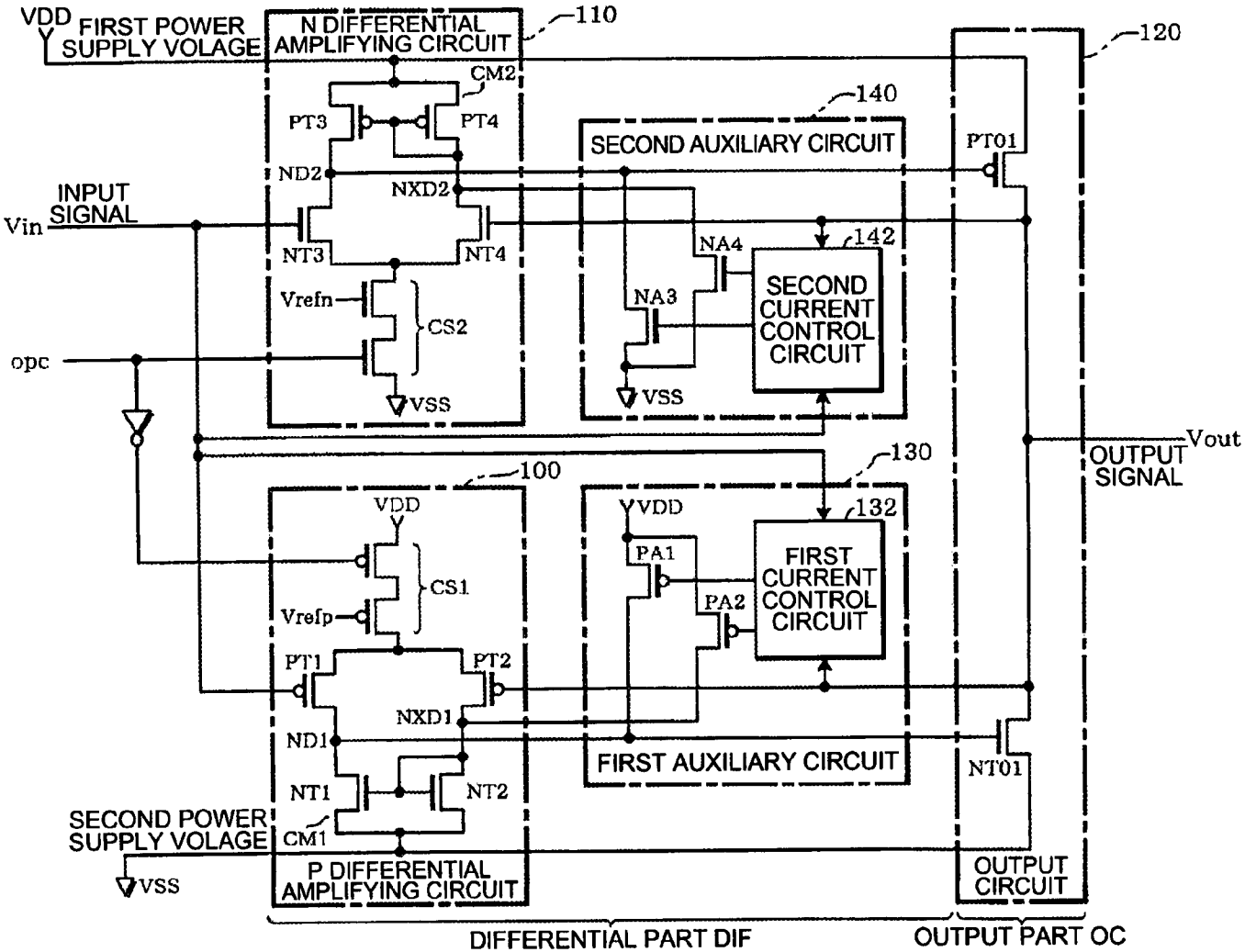
FIG. 23 shows an example configuration of the voltage follower circuit shown in FIG. 18.

FIG. 23 shows an example configuration of the voltage follower circuit VF according to the present embodiment.

The differential part DIF of this voltage follower circuit VF includes a P (e.g. first conductive) differential amplifying circuit 100 and an N (e.g. second conductive) differential amplifying circuit 110. The output part OC of the voltage follower circuit VF includes an output circuit 120. The P differential amplifying circuit 100, the N differential amplifying circuit 110, and the output circuit 120 have an operational voltage between the high potential power supply voltage VDD (first power supply voltage in a broad sense) and the low potential power supply voltage VSS (second power supply voltage).

The P differential amplifying circuit 100 amplifies a differential between the input signal Vin and the output signal Vout. The P differential amplifying circuit 100 includes an output node ND1 (first output node) and an inverted output node NXD1 (first inverted output node), and outputs, between the output node ND1 and the inverted output node NXD1, a voltage corresponding to the differential between the input signal Vin and the output signal Vout.

This P differential amplifying circuit 100 also includes a first current mirror circuit CM1 and a first pair of P-channel (first conductive) differential transistors. The first pair of differential transistors includes P-channel metal oxide semiconductor (MOS) transistors (hereinafter simply referred to as "the transistors") PT1 and PT2. Each source of the P-channel transistors PT1 and PT2 is coupled to a first current source CS1. To each gate of the transistors, the input signal Vin and the output signal Vout are supplied. Drain currents of the P-channel transistors PT1 and PT2 are generated by the first current mirror circuit CM1. The input signal Vin is supplied to the gate of the P-channel transistor PT1, while the output signal Vout is supplied to the gate of the P-channel transistor PT2. The drain of the P-channel transistor PT1 serves as the output node ND1 (first output node), while the drain of the P-channel transistor PT2 serves as the inverted output node NXD1 (first inverted output node).

In the first current source CS1, the drain of the P-channel transistor whose gate is coupled to a constant voltage Vrefp for generating a constant current is provided with the high potential power supply voltage VDD via a power save control transistor. The gate of this power save control transistor is provided with an inverted signal of the power save control signal opc.

The N differential amplifying circuit 10 amplifies a differential between the input signal Vin and the output signal Vout. The N differential amplifying circuit 110 includes an output node ND2 (second output node) and an inverted output node NXD2 (second inverted output node), and outputs, between the output node ND2 and the inverted output node NXD2, a voltage corresponding to the differential between the input signal Vin and the output signal Vout.

The N differential amplifying circuit 110 also includes a second current mirror circuit CM2 and a second pair of N-channel (second conductive) differential transistors. The second pair of differential transistors includes N-channel transistors NT3 and NT4. Each source of the N-channel transistors NT3 and NT4 is coupled to a second current source CS2. To each gate of these transistors, the input signal Vin and the output signal Vout are supplied. Drain currents of the N-channel transistors NT3 and NT4 are generated by the second current mirror circuit CM2. The input signal Vin is supplied to the gate of the N-channel transistor NT3, while the output signal Vout is supplied to the gate of the N-channel transistor NT4. The drain of the N-channel transistor NT3 serves as the output node ND2 (second output node), while the drain of the N-channel transistor NT4 serves as the inverted output node NXD2 (second inverted output node).

In the second current source CS2, the drain of the N-channel transistor whose gate is coupled to a constant voltage Vrefn for generating a constant current is provided with the low potential power supply voltage VSS via a power save control transistor. The gate of this power save control transistor is provided with the power save control signal opc.

The output circuit 120 generates the output signal Vout based on a voltage at the output node ND1 (first output node) of the P differential amplifying circuit 100 and a voltage at the output node ND2 (second output node) of the N differential amplifying circuit 110.

This output circuit 120 includes an N (second conductive type) first driving transistor NTO1 and a P (first conductive type) second driving transistor PTO1. The gate (voltage) of the first driving transistor NTO1 is controlled based on a voltage at the output node ND1 (first output node) of the P differential amplifying circuit 100. The gate (voltage) of the second driving transistor PTO1 is controlled based on a voltage at the output node ND2 (second output node) of the N differential amplifying circuit 110. The drain of the second driving transistor PTO1 is coupled to the drain of the first driving transistor NTO1. The output circuit 120 outputs a voltage of the drain of the first driving transistor NTO1 (voltage of the drain of the second driving transistor PTO1) as the output signal Vout.

Furthermore, the voltage follower circuit VF according to the present embodiment includes a first auxiliary circuit 130 and a second auxiliary circuit 140, and thereby eliminating an input insensitive zone and reducing a through current. Also, since the gate voltages of the first driving transistor NTO1 and the second driving transistor PTO1 can be charged at a high rate, the differential part DIF can operate at high speed. As a result, the through current can be reduced to achieve low power consumption and high speed operation without an extra range of operational voltages.

Here, the first auxiliary circuit 130, based on the input signal Vin and the output signal Vout, drives at least one of the output node ND1 (first output node) and the inverted output node NXD1 (first inverted output node) of the P differential amplifying circuit 100. The second auxiliary circuit 140, based on the input signal Vin and the output signal Vout, drives at least one of the output node ND2 (second output node) and the second inverted output node NXD2 of the N differential amplifying circuit 110.

If the absolute value of a voltage between the gate and source of the P-channel transistor PT1, of the first pair of differential transistors, whose gate is provided with the input signal Vin is smaller than the absolute value of a threshold voltage of the P-channel transistor PT1, the first auxiliary circuit 130 drives at least one of the output node ND1 (first output node) and the inverted output node NXD1 (first inverted output node), and thereby controlling the gate voltage of the first driving transistor NTO1.

If the absolute value of a voltage between the gate and source of the N-channel transistor NT3, of the second pair of differential transistors, whose gate is provided with the input signal Vin is smaller than the absolute value of a threshold voltage of the N-channel transistor NT3, the second auxiliary circuit 140 drives at least one of the output node ND2 (second output node) and the inverted output node NXD2 (second inverted output node), and thereby controlling the gate voltage of the second driving transistor PTO1.

Figure 24:
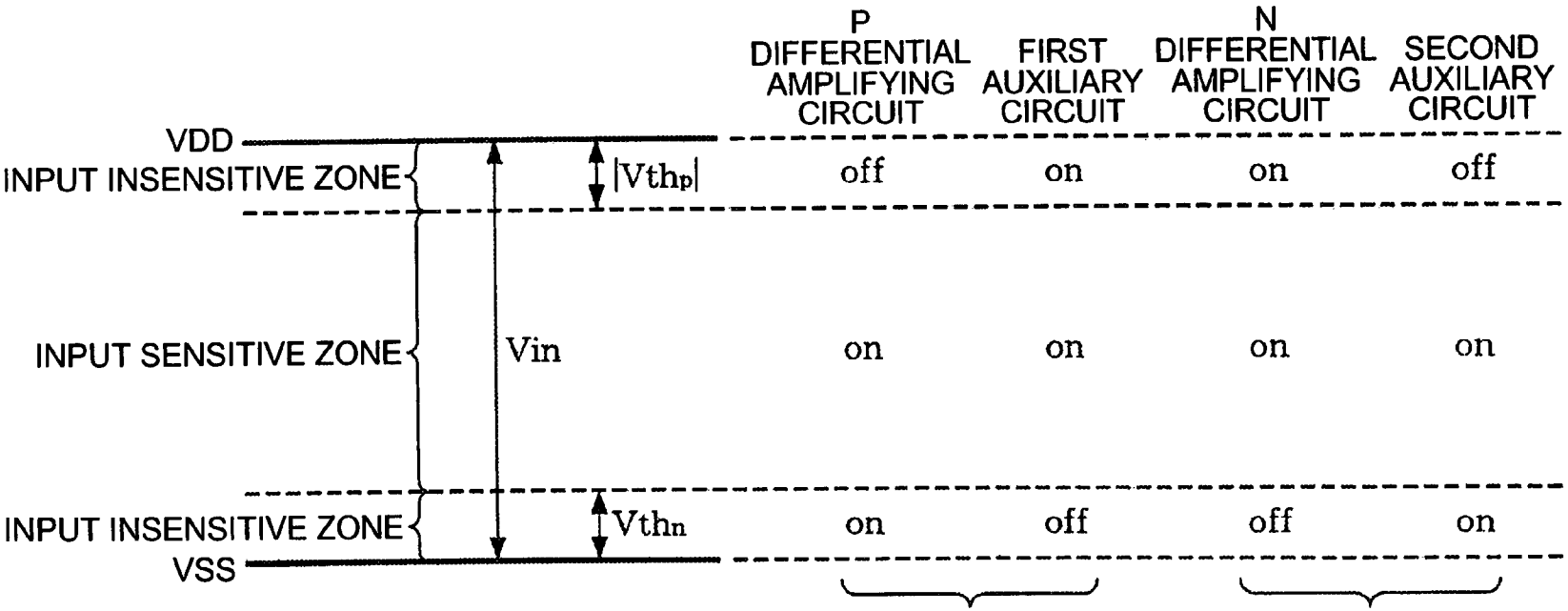
FIG. 24 illustrates operations of the voltage follower circuit shown in FIG. 23.

FIG. 24 illustrates operations of the voltage follower circuit VF shown in FIG. 23.

Here, a threshold voltage Vthp of the P-channel transistor PT1 and a threshold voltage Vthn of the N-channel transistor NT3 will be referred along with the high potential power supply voltage VDD, the low potential power supply voltage VSS, and the input signal voltage Vin.

The P-channel transistors are turned off, while the N-channel transistors are turned on when the following formula is satisfied:

$$VDD \geqq Vin > VDD - |Vthp|$$

As for P-channel transistors that operate in a cut-off area, linear area, or saturation area in accordance with a gate voltage, the P-channel transistors being "off" means that they are in the cut-off area. Likewise, as for N-channel transistors operate in a cut-off area, linear area, or saturation area in accordance with a gate voltage, the N-channel transistors being "on" means that they are in the linear or saturation area. Consequently, the P differential amplifying circuit 100 does not operate (off), while the N differential amplifying circuit 110 operates (on) when the formula $$VDD \geqq Vin > VDD - |Vthp|$$

is satisfied. Therefore, the first auxiliary circuit 130 is turned on by driving at least one of the output node ND1 (first output node) and the inverted output node NXD1 (first inverted output node), while the second auxiliary circuit 140 is turned off by not driving the output node ND2 (second output node) and the inverted output node NXD2 (second inverted output node). Thus the first auxiliary circuit 130 drives the output node ND1 (or the inverted output node NXD1) of the P differential amplifying circuit 100 in a range that does not make the P differential amplifying circuit 100 operate, and thereby eliminating the possibility of making a voltage at the output note ND1 unstable with respect to the input signal Vin in the input insensitive zone for the first pair of differential transistors of the P differential amplifying circuit 100.

Both the P-channel and N-channel transistors are turned on when the following formula is satisfied:

$$VDD - |Vthp| \geqq Vin \geqq Vthn + VSS$$

As for P-channel transistors that operate in a cut-off area, linear area, or saturation area in accordance with a gate voltage, the P-channel transistors being "off" means that they are in the linear or saturation area. Consequently, both the P differential amplifying circuit 100 and the N differential amplifying circuit 110 operate (on). In this case, the first auxiliary circuit 130 is turned on or off, and the second auxiliary circuit 140 is also turned on or off. In other words, the P differential amplifying circuit 100 and the N differential amplifying circuit 110 operate, and thereby eliminating the possibility of making the output nodes ND1 and ND2 unstable. The output circuit 120 thus outputs the output signal Vout. Accordingly, both the first auxiliary circuit 130 and the second auxiliary circuit 140 may or may not operate. Referring to FIG. 24, they are turned on.

The P-channel transistors are turned on, while the N-channel transistors are turned off when the following formula is satisfied:

$$Vthn + VSS > Vin \geqq VSS$$

As for N-channel transistors that operate in a cut-off area, linear area, or saturation area in accordance with a gate voltage, the N-channel transistors being "off" means that they are in the cut-off area. Consequently, the N differential amplifying circuit 110 does not operate (off), while the P differential amplifying circuit 100 operates (on). Therefore, the second auxiliary circuit 140 is turned on by driving at least one of the output node ND2 (second output node) and the inverted output node NXD2 (second inverted output node), while the first auxiliary circuit 130 is turned off. Thus the second auxiliary circuit 140 drives the output node ND2 (or the inverted output node NXD2) of the N differential amplifying circuit 110 in a range that does not make the N differential amplifying circuit 110 operate, and thereby eliminating the possibility of making a voltage at the output note ND2 unstable with respect to the input signal Vin in the input insensitive zone for the second pair of differential transistors of the N differential amplifying circuit 110.

As mentioned above, the first auxiliary circuit 130 and the second auxiliary circuit 140 control the gate voltages of the first driving transistor NTO1 and the second driving transistor PTO1 included in the output circuit 120, and thereby eliminating an unnecessary through current caused in the input insensitive zone of the input signal Vin. This elimination of the input insensitive zone of the input signal Vin further makes it possible to eliminate an offset to make up variations in the threshold voltage Vthp of the P-channel transistors and the threshold voltage Vthn of the N-channel transistors. As a result, the voltage follower circuit VF can be provided with a voltage between the high potential power supply voltage VDD and the low potential power supply voltage VSS as an amplitude. Therefore, it is possible to narrow an operational voltage without lowering driving capability and to reduce power consumption. Furthermore, it is possible to mount a booster circuit and reduce required voltages during the manufacturing process, which further reduces cost.

In addition, since the first auxiliary circuit 130 and the second auxiliary circuit 140 drive the output nodes ND1 and ND2, the reaction rate of the differential part can be increased, while a capacitor for phase compensation can be eliminated. Furthermore, by decreasing the current driving capability of both the first driving transistor NTO1 and the second driving transistor PTO1 of the output part OC, the reaction rate of the output part OC can be decreased.

An example configuration of the voltage follower circuit VF according to the present embodiment will now be described in greater detail.

Referring to FIG. 23, the P differential amplifying circuit 100 includes the first current source CS1, the first pair of differential transistors, and the first current mirror circuit CM1. To one end of the first current source CS1, the high potential power supply voltage VDD (first power supply voltage) is supplied. To the other end of the first current source CS1, the sources of the P-channel transistors PT1 and PT2 making up the first pair of differential transistors are coupled.

The first current mirror circuit CM1 includes the first pair of N-channel (second conductive) transistors whose gates are coupled to each other. This first pair of transistors includes the N-channel transistors NT1 and NT2. To each source of the N-channel transistors NT1 and NT2, the low potential power supply voltage VSS (second power supply voltage) is supplied. The drain of the N-channel transistor NT1 is coupled to the output node ND1 (first output node), while the drain of the N-channel transistor NT2 is coupled to the inverted output node NXD1 (first inverted output node). Of the transistors making up the first pair of differential transistors, the N-channel transistor NT2 that is coupled to the inverted output node NXD1 has the drain and source that are coupled.

The N differential amplifying circuit 110 includes the second current source CS2, the second pair of differential transistors, and the second current mirror circuit CM2. To one end of the second current source CS2, the low potential power supply voltage VSS (second power supply voltage) is supplied. To the other end of the second current source CS2, the sources of the N-channel transistors NT3 and NT4 making up the second pair of differential transistors are coupled.

The second current mirror circuit CM2 includes the second pair of P-channel (first conductive) transistors whose gates are coupled to each other. This second pair of transistors includes the P-channel transistors PT3 and PT4. To each source of the P-channel transistors PT3 and PT4, the high potential power supply voltage VDD (first power supply voltage) is supplied. The drain of the P-channel transistor PT3 is coupled to the output node ND2 (second output node), while the drain of the P-channel transistor PT4 is coupled to the inverted output node NXD2 (second inverted output node). Of the transistors making up the second pair of differential transistors, the P-channel transistor PT4 that is coupled to the inverted output node NXD2 has the drain and source that are coupled.

Further, the first auxiliary circuit 130 may include P-channel (first conductive), first and second current driving transistors PA1 and PA2, and a first current control circuit 132. To each source of the first and second current driving transistors PA1 and PA2, the high potential power supply voltage VDD (first power supply voltage) is supplied. The drain of the first current driving transistor PA1 is coupled to the output node ND1 (first output node), while the drain of the second current driving transistor PA2 is coupled to the inverted output node NXD1 (first inverted output node).

The first current control circuit 132, based on the input signal (Vin) and the output signal (Vout), controls the gate voltages of the first and second current driving transistors PA1 and PA2. Specifically, if the absolute value of a voltage between the gate and source of the P-channel transistor PT1, of the first pair of differential transistors, whose gate is provided with the input signal Vin is smaller than the absolute value of a threshold voltage of this transistor, the first current control circuit 132 controls the first and second current driving transistors PA1 and PA2 so as to drive at least one of the output node ND1 (first output node) and the inverted output node NXD1 (first inverted output node).

The second auxiliary circuit 140 may include N-channel (second conductive), third and fourth current driving transistors NA3 and NA4, and a second current control circuit 142. To each source of the third and the fourth current driving transistors NA3 and NA4, the low potential power supply voltage VSS (second power supply voltage) is supplied. The drain of the third current driving transistor NA3 is coupled to the output node ND2 (second output node), while the drain of the fourth current driving transistor NA4 is coupled to the inverted output node NXD2 (second inverted output node).

The second current control circuit 142, based on the input signal (Vin) and the output signal (Vout), controls the gate voltages of the third and the fourth current driving transistors NA3 and NA4. Specifically, if the absolute value of a voltage between the gate and source of the N-channel transistor NT3, of the second pair of differential transistors, whose gate is provided with the input signal Vin is smaller than the absolute value of a threshold voltage of this transistor, the second current control circuit 142 controls the third and the fourth current driving transistors NA3 and NA4 so as to drive at least one of the output node ND2 (second output node) and the inverted output node NXD2 (second inverted output node).

Referring to FIG. 23, the reaction rate of the differential part DIF corresponds to time required for the gate voltages of the first driving transistor NTO1 and the second driving transistor PTO1 to reach a predetermined level after the input signal Vin changes. The reaction rate of the output part OC corresponds to time required for the output signal Vout to reach a predetermined level after the gate voltages of the first driving transistor NTO1 and the second driving transistor PTO1 change.

Figure 25:
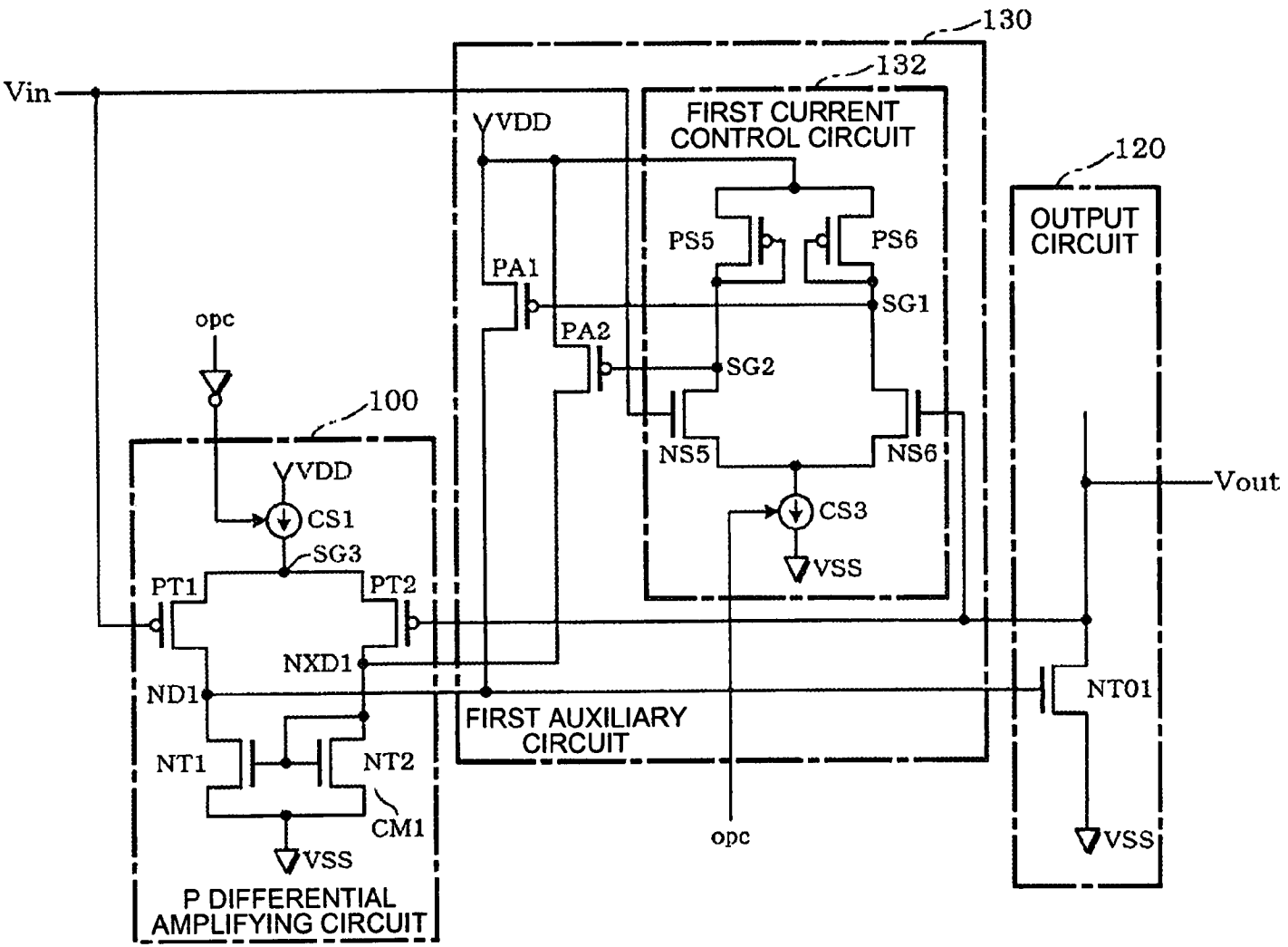
FIG. 25 shows an example configuration of the first current control circuit.

FIG. 25 shows an example configuration of the first current control circuit 132. The parts same as shown in FIG. 23 are given the same numerals in FIG. 25 and the explanation thereof will be omitted here.

The first current control circuit 132 includes a third current source CS3 and a third pair of N-channel (second conductive) differential transistors. The first current control circuit 132 also includes P-channel (first conductive), fifth and sixth current driving transistors PS5 and PS 6.

To one end of the third current source CS3, the low potential power supply voltage VSS (second power supply voltage) is supplied. In the third current source CS3, in the same manner as the second current source CS2, the drain of the N-channel transistor whose gate is coupled to the constant voltage Vrefn for generating a constant current is provided with the low potential power supply voltage VSS via a power save control transistor. The gate of this power save control transistor is provided with the power save control signal opc.

The third pair of differential transistors includes N-channel transistors NS5 and NS6. Each source of the N-channel transistors NS5 and NS6 is coupled to the other end of the third current source CS3. The input signal Vin is supplied to the gate of the N-channel transistor NS5, while the output signal Vout is supplied to the gate of the N-channel transistor NS6.

To each source of the fifth and sixth current driving transistors PS5 and PS 6, the high potential power supply voltage VDD (first power supply voltage) is supplied. The drain of the fifth current driving transistor PS5 is coupled to the drain of the N-channel transistors NS5 making up the third pair of differential transistors, while the drain of the sixth current driving transistor PS6 is coupled to the drain of the N-channel transistors NS6 also making up the third pair of differential transistors. The gate and the drain of the fifth current driving transistor PS5 are coupled, while the gate and the drain of the sixth current driving transistor PS6 are coupled.

Of the third pair of differential transistors, the N-channel transistor NS5 whose gate is provided with the input signal Vin (or the fifth current driving transistor PS5) has the drain coupled to the gate of the second current driving transistor PA2. Of the third pair of differential transistors, the N-channel transistor NS6 whose gate is provided with the output signal Vout (or the sixth current driving transistor PS6) has the drain coupled to the gate of the first current driving transistor PA1.

In other words, the first and sixth current driving transistors PA1 and PS6 make up a current mirror circuit. Likewise, the second and fifth current driving transistors PA2 and PS5 make up a current mirror circuit.

Figure 26:
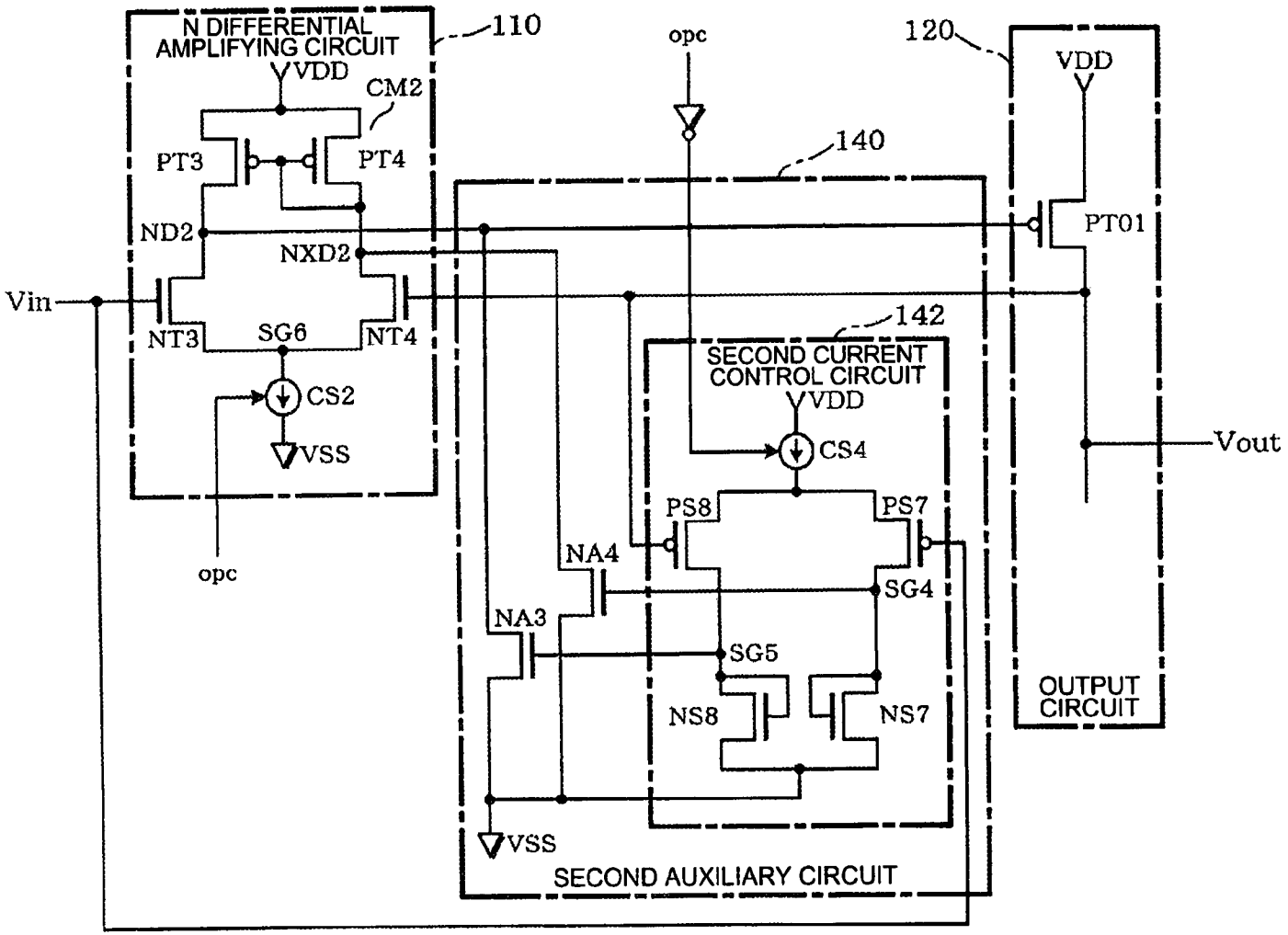
FIG. 26 shows an example configuration of the second current control circuit.

FIG. 26 shows an example configuration of the second current control circuit 142. The parts same as shown in FIG. 23 are given the same numerals in FIG. 26 and the explanation thereof will be omitted here.

The second current control circuit 142 includes a fourth current source CS4 and a fourth pair of P-channel (first conductive) differential transistors. The second current control circuit 142 also includes N-channel (second conductive), seventh and eighth current driving transistors NS7 and NS8.

To one end of the fourth current source CS4, the high potential power supply voltage VDD (first power supply voltage) is supplied. In the fourth current source CS4, in the same manner as the first current source CS1, the drain of the P-channel transistor whose gate is coupled to the constant voltage Vrefp for generating a constant current is provided with the high potential power supply voltage VDD via a power save control transistor. The gate of this power save control transistor is provided with an inverted signal of the power save control signal opc.

The fourth pair of differential transistors includes P-channel transistors PS7 and PS8. Each source of the P-channel transistors PS7 and PS8 is coupled to the other end of the fourth current source CS4. The input signal Vin is supplied to the gate of the P-channel transistor PS7, while the output signal Vout is supplied to the gate of the P-channel transistor PS8.

To each source of the seventh and the eighth current driving transistors NS7 and NS8, the low potential power supply voltage VSS (second power supply voltage) is supplied. The drain of the seventh current driving transistor NS7 is coupled to the drain of the P-channel differential transistor PS7 making up the fourth pair of differential transistors, while the drain of the eighth current driving transistor NS8 is coupled to the drain of the P-channel transistor PS8 also making up the fourth pair of differential transistors. The gate and the drain of the seventh current driving transistor NS7 are coupled, while the gate and the drain of the eighth current driving transistor NS8 are coupled.

Of the fourth pair of differential transistors, the P-channel transistor PS7 whose gate is provided with the input signal Vin (or the seventh current driving transistor NS7) has the drain coupled to the gate of the fourth current driving transistor NA4. Of the fourth pair of differential transistors, the P-channel transistor PS8 whose gate is provided with the output signal Vout (or the eighth current driving transistor NS8) has the drain coupled to the gate of the third current driving transistor NA3.

In other words, the third and eighth current driving transistors NA3 and NS8 make up a current mirror circuit. Likewise, the fourth and the seventh current driving transistors NA4 and NS7 make up a the current mirror circuit.

Operations of the voltage follower circuit VF having the configuration shown in FIG. 23 will now be described in which the first auxiliary circuit 130 includes the first current control circuit 132 shown in FIG. 25 and the second auxiliary circuit 140 includes the second current control circuit 142 shown in FIG. 26.

When the formula, $$Vthn+VSS \geqq Vin > VSS$$

is satisfied, the P-channel transistor PT1 is turned on and makes the P differential amplifying circuit 100 properly operate, while the N-channel transistor NT3 does not work and makes each node voltage of the N differential amplifying circuit 110 inconsistent.

As for the second auxiliary circuit 140, since the P-channel transistor PS7 is turned on and lowers impedance, the gate voltage of the fourth current driving transistor NA4 increases. As a result, the impedance of the fourth current driving transistor NA4 decreases. In other words, the fourth current driving transistor NA4 drives the inverted output node NXD2 and draws a current, and thereby lowering the potential of the inverted output node NXD2. Consequently, the impedance of the P-channel transistor PT3 decreases, while the potential of the output node ND2 increases. The impedance of the second driving transistor PTO1 included in the output circuit 120 increases, while the potential of the output signal Vout decreases. Therefore, the impedance of the P-channel transistor PS8 decreases, while the gate voltage of the third current driving transistor NA3 increases. Consequently, the impedance of the third current driving transistor NA3 decreases, and the potential of the output node ND2 decreases.

The result of decreasing the impedance of the P-channel transistor PT3 and increasing the potential of the output node ND2 is fed back, and thereby decreasing the impedance of the third current driving transistor NA3 and decreasing the potential of the output node ND2. As a result, the voltages of the input signal Vin and the output signal Vout are almost equalized. Thus the gate voltage of the second driving transistor PTO1 is settled at an optimum point.

Effects are opposite to what have been described when the following formula is satisfied:

$$VDD \geqq Vin > VDD - |Vthp|$$

Specifically, the N-channel transistor NT3 is turned on and makes the N differential amplifying circuit 110 properly operate, while the P-channel transistor PT1 does not work and makes each node voltage of the P differential amplifying circuit 100 inconsistent.

As for the first auxiliary circuit 130, since the N-channel transistor NS5 is turned on and lowers impedance, the gate voltage of the second current driving transistor PA2 decreases. As a result, the impedance of the second current driving transistor PA2 decreases. In other words, the second current driving transistor PA2 drives the inverted output node NXD1 and supplies a current, and thereby raising the potential of the inverted output node NXD1. Consequently, the impedance of the N-channel transistor NT2 decreases, and the potential of the output node ND1 decreases. The impedance of the first driving transistor NTO1 included in the output circuit 120 increases, and the potential of the output signal Vout increases. Therefore, the impedance of the N-channel transistor NS6 decreases, and the gate voltage of the first current driving transistor PA1 decreases. Consequently, the impedance of the first current driving transistor PA1 decreases, while the potential of the output node ND1 increases.

The result of decreasing the impedance of the N-channel transistor NT2 and decreasing the potential of the output node ND1 is fed back, and thereby decreasing the impedance of the first current driving transistor PA1 and increasing the potential of the output node ND1. As a result, the voltages of the input signal Vin and the output signal Vout are almost equalized. Thus the gate voltage of the first driving transistor NTO1 is settled at an optimum point.

It should be noted that when the formula $$VDD-|Vthp| \geqq Vin \geqq Vthn+VSS$$

is satisfied, both the P differential multiplying circuit 100 and the N differential amplifying circuit 110 operate, establishing the potentials of the output nodes ND1 and ND2. Therefore, the voltages of the input signal Vin and the output signal Vout are almost equalized without operating the first and the second auxiliary circuits 130 and 140.

Figure 27:
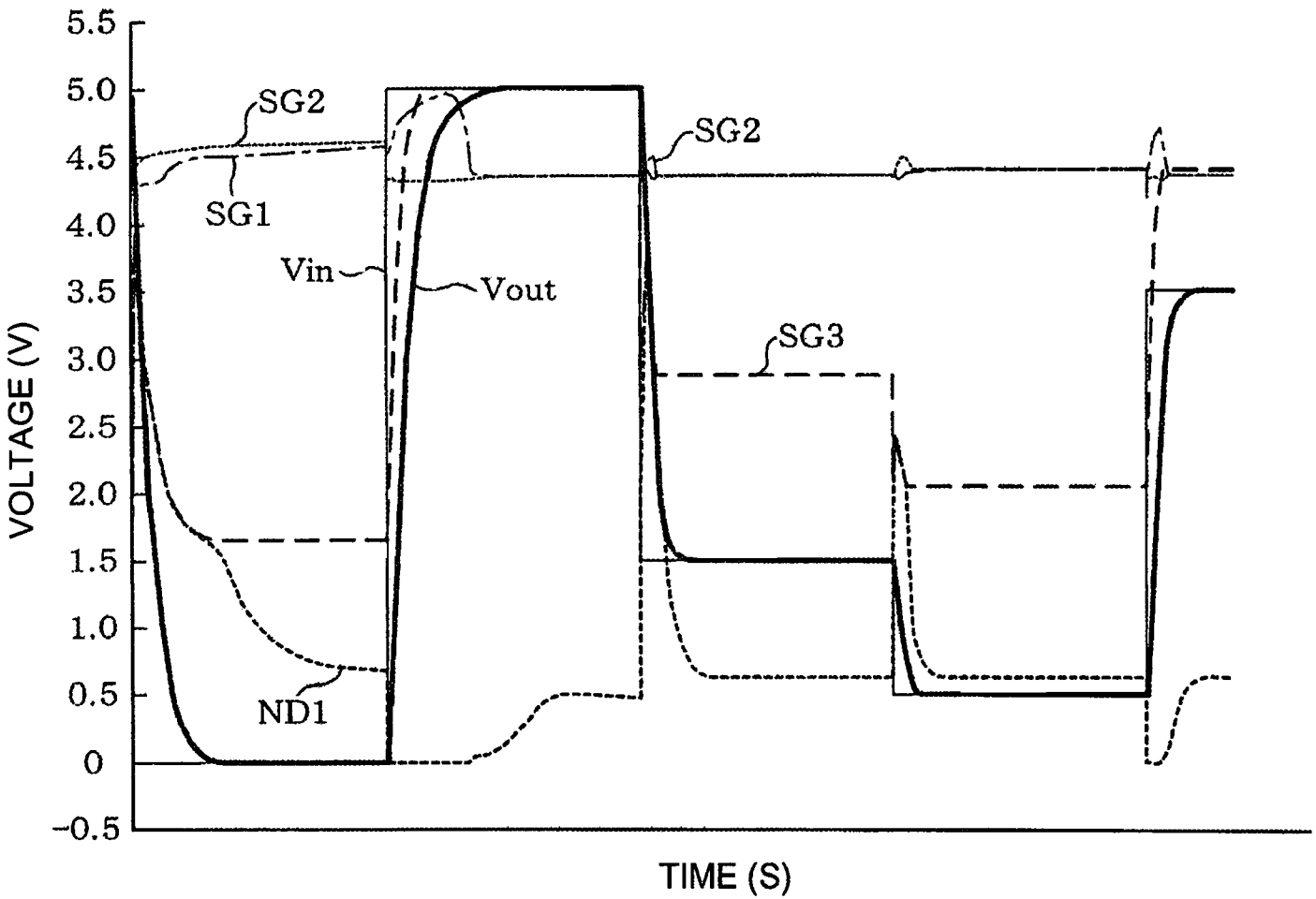
FIG. 27 shows simulation results about voltage changes at nodes of a P differential amplifying circuit and a first auxiliary circuit.
Figure 28:
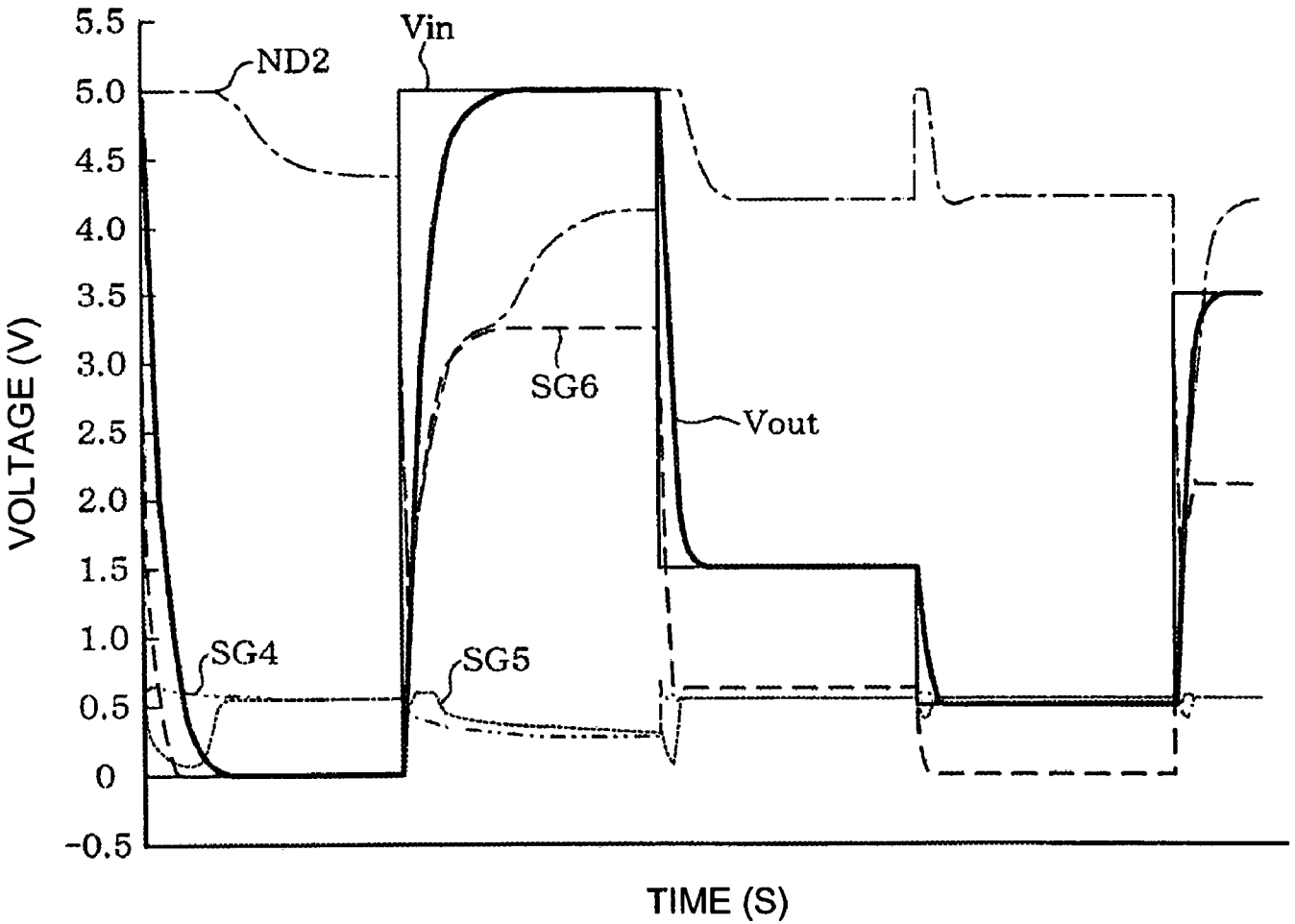
FIG. 28 shows simulation results about voltage changes at nodes of an N differential amplifying circuit and a second auxiliary circuit.
Figure 29:
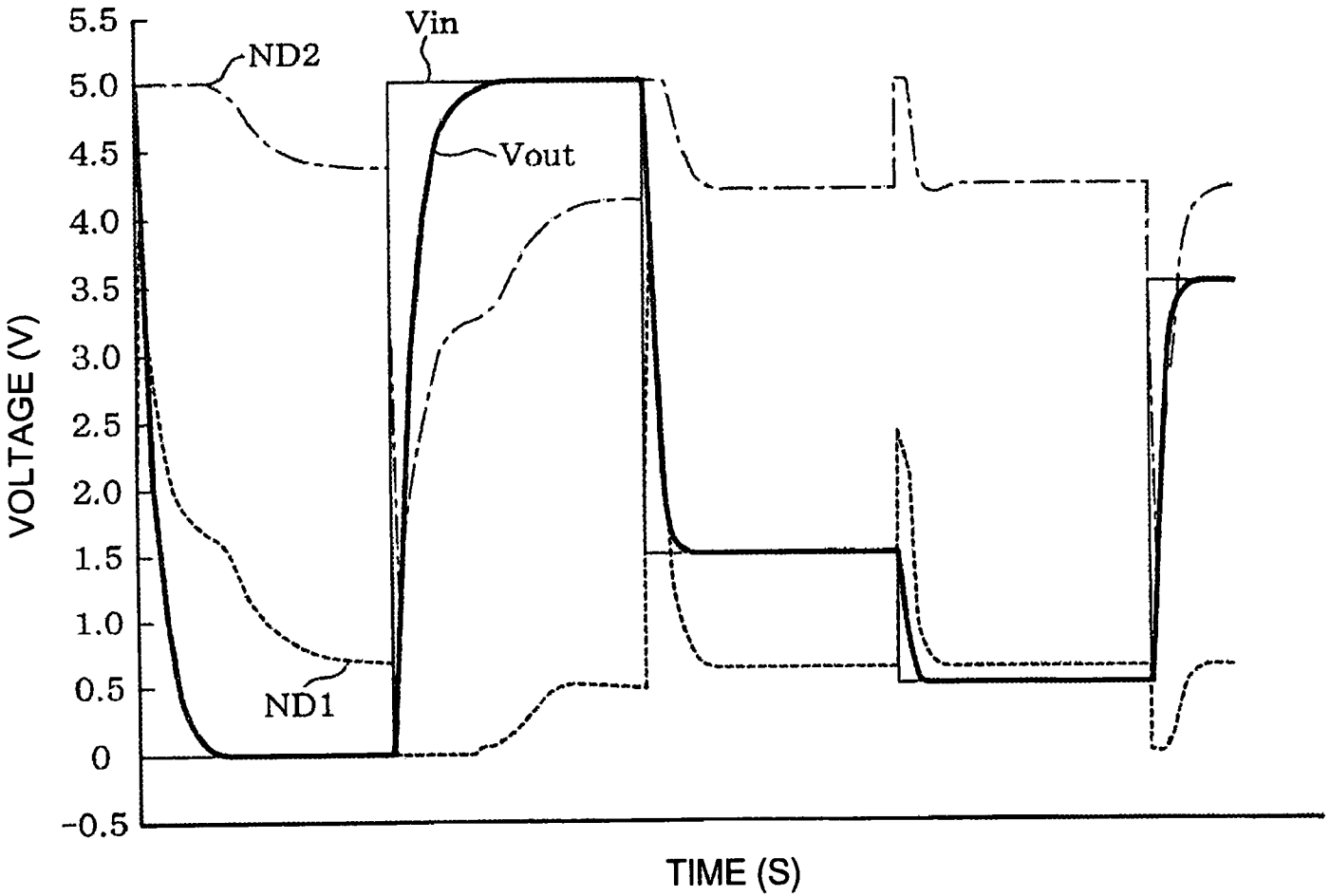
FIG. 29 shows simulation results about voltage changes at output nodes.

FIG. 27 shows simulation results about voltage changes at nodes of the P differential amplifying circuit 100 and the first auxiliary circuit 130. FIG. 28 shows simulation results about voltage changes at nodes of the N differential amplifying circuit 110 and the second auxiliary circuit 140. FIG. 29 shows simulation results about voltage changes at the output nodes ND1 and ND2.

Referring to FIG. 27, a node SG1 is the gate of the first current driving transistor PA1. A node SG2 is the gate of the second current driving transistor PA2. A node SG3 is the source of the P-channel transistors PT1 and PT2 making up the first pair of differential transistors.

Referring to FIG. 28, a node SG4 is the gate of the fourth current driving transistor NA4. A node SG5 is the gate of the third current driving transistor NA3. A node SG6 is the source of the N-channel transistors NT3 and NT4 making up the second pair of differential transistors.

As shown in FIGS. 27 through 29, even inputting an input signal Vin of about 0.5 volts does not make the output node ND1 inconsistent. The gate voltage of the first driving transistor NTO1 included in the output circuit 120 is thus controlled.

Figure 30:
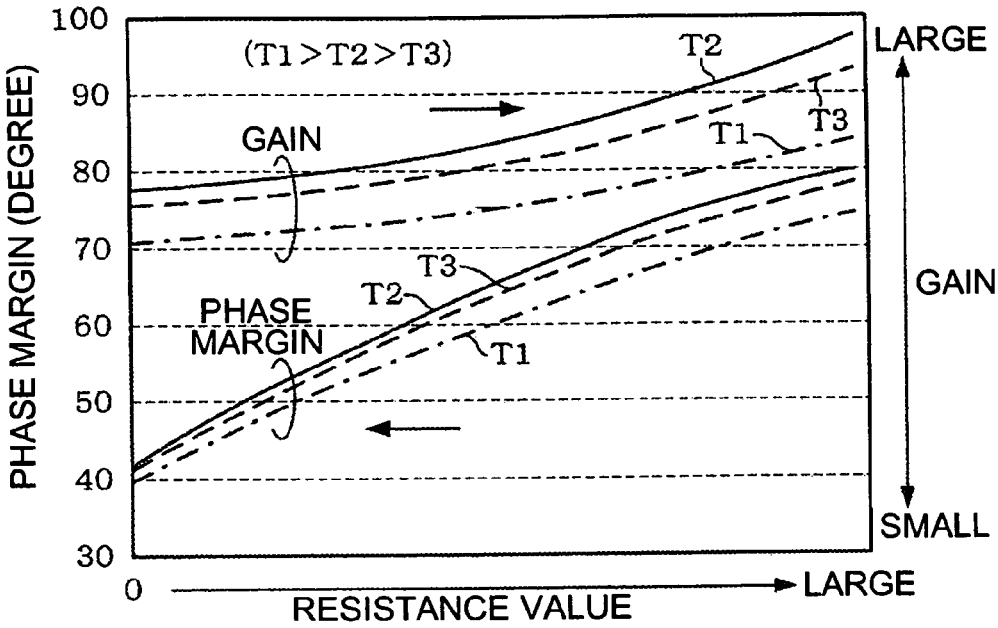
FIG. 30 shows simulation results about changes in phase margins and gains of an operational amplifying circuit with load unconnected.

FIG. 30 shows simulation results about changes in phase margins and gains of the impedance conversion circuit IPC including the voltage follower circuits VF as shown in FIG. 23 through 25 with load unconnected. This chart shows changes in phase margins and gains in line with resistance values of the resistance circuit RC at operating temperatures T1, R2, T3 (T1>T2>T3). As shown in this chart, phase margins can be set by changing resistance values of the resistance circuit RC in the impedance conversion circuit IPC with load unconnected.

Figure 31:
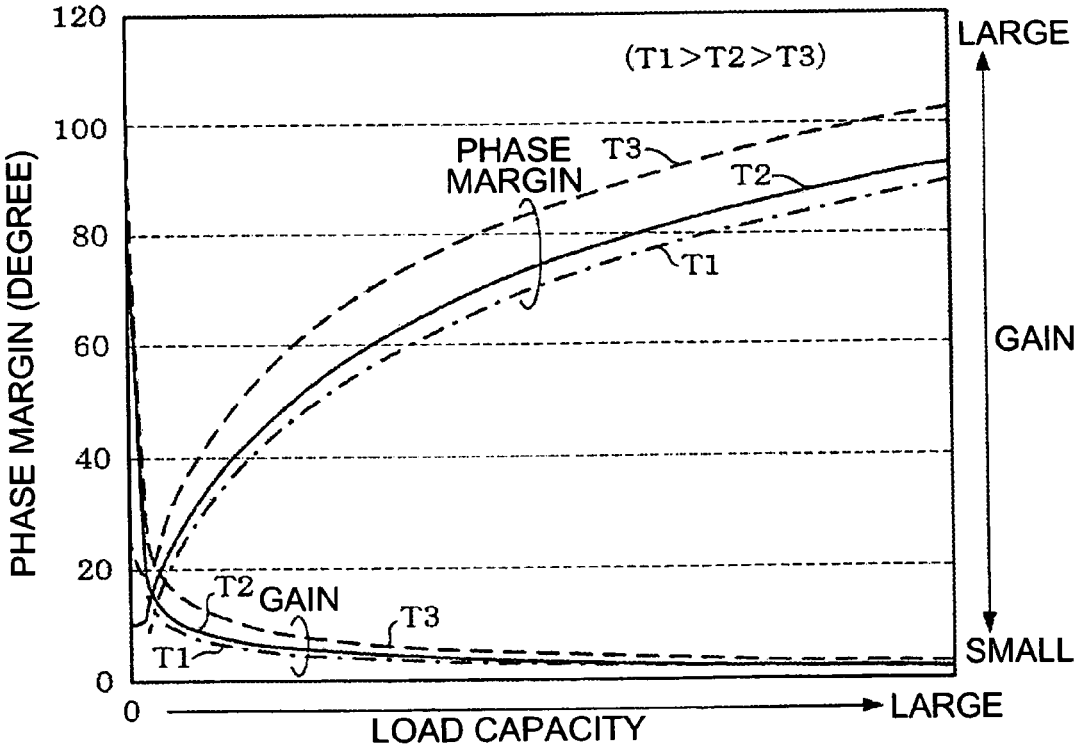
FIG. 31 shows simulation results about changes in phase margins and gains of an operational amplifying circuit with load connected.

FIG. 31 shows simulation results about changes in phase margins and gains of the impedance conversion circuit IPC including the voltage follower circuits VF as shown in FIG. 23 through 25 with load connected. This chart shows changes in phase margins and gains in line with capacities of the load LD at a fixed resistance value of the resistance circuit RC at operating temperatures T1, R2, T3 (T1>T2>T3). As shown in this chart, the larger capacities of the load LD, the larger phase margins in this impedance conversion circuit IPC.

Accordingly, the impedance conversion circuit IPC including the voltage follower circuits VF of the present embodiment can eliminate an input insensitive zone, provide rail-to-rail operation, and surely prevent a through current in the output circuit 120. Consequently, the impedance conversion circuit can largely reduce power consumption. Moreover, since class-AB operation is possible, data lines can be stably driven regardless of polarity in polarity inversion drive in which a voltage applied to liquid crystal is inverted.

In addition, since the first auxiliary circuit 130 and the second auxiliary circuit 140 drive the output nodes ND1 and ND2, the reaction rate of the differential part can be increased, while a capacitor for phase compensation can be eliminated. Furthermore, by decreasing the current driving capability of both the first driving transistor NTO1 and the second driving transistor PTO1 of the output part OC, the reaction rate of the output part OC can be decreased. Therefore, various types of display panels with different load capacities that are used to increase the size of the panels can be driven with the same impedance conversion circuit.

It is necessary for a voltage follower circuit that returns the output signal Vout to prevent oscillation so as to stabilize its output. A typical solution for this is to couple a capacity for phase compensation between a differential amplifying circuit and an output circuit to provide a phase margin. In this case, it is known that a slew rate S that represents the performance of a voltage follower circuit is proportional to I/C, where I is a consumption current and C is a capacity of the capacitor for phase compensation. In other words, it is necessary to decrease the capacity C or increase the consumption current I in order to increase the slew rate of the voltage follower circuit.

According to the present embodiment, however, such a capacitor for phase compensation is not required, and thereby the slew rate is not defined by the above-mentioned formula. Consequently, the slew rate can be increased without increasing the consumption current I.

2.3.3 Current Value Adjustment

The stability of the voltage follower circuit VF according to the present embodiment can be further enhanced by adjusting current values for operating the current sources of the P differential amplifying circuit 100, the N differential amplifying circuit 110, the first auxiliary circuit 130, and the second auxiliary circuit 140.

Figure 32:
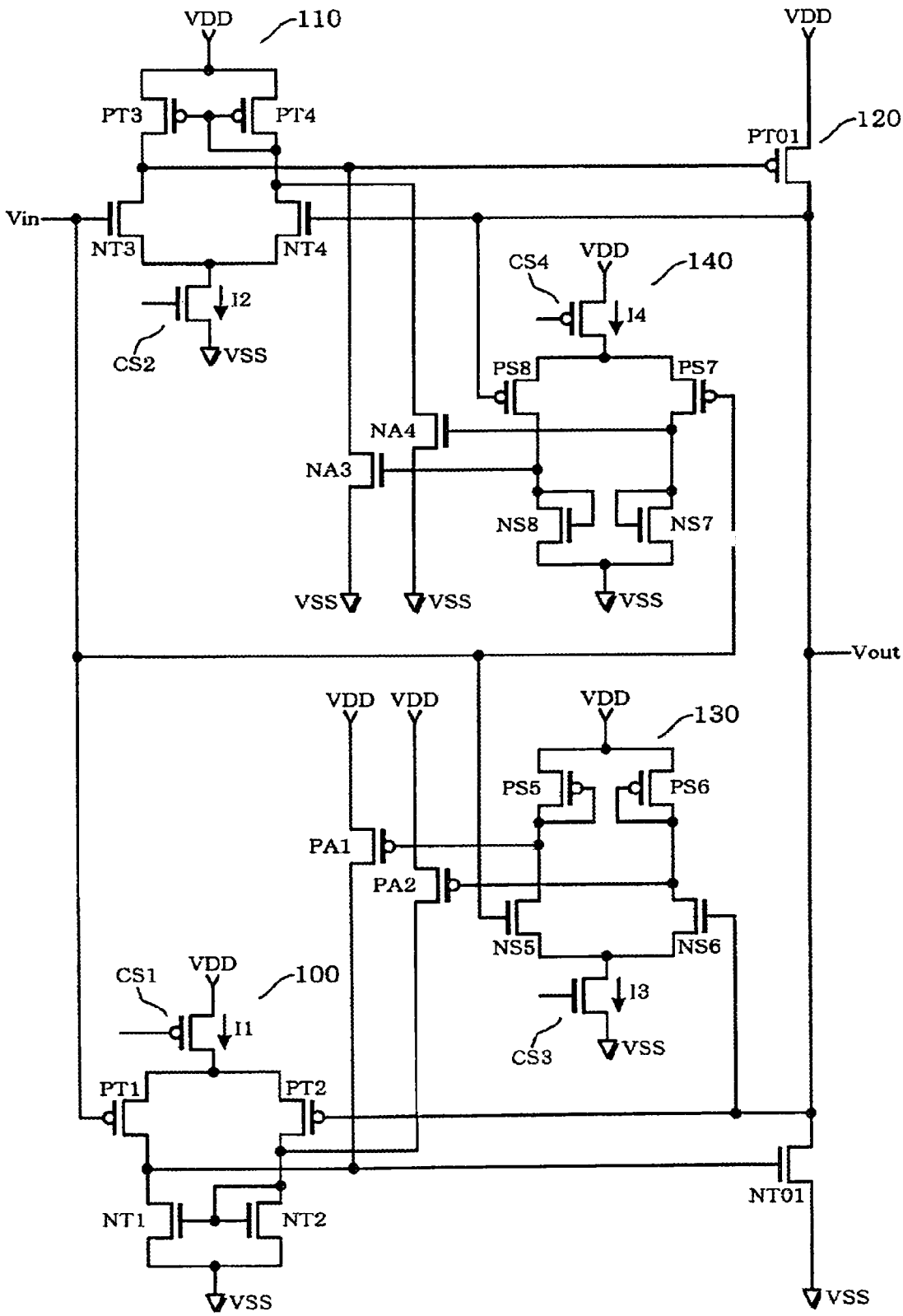
FIG. 32 shows another example configuration of the voltage follower circuit shown in FIG. 18.

FIG. 32 shows another example configuration of the voltage follower circuit VF according to the present embodiment. While a transistor for controlling power save is not shown in FIG. 32, it should be understood that unnecessary power consumption at current sources can be reduced as mentioned above by means of the control with the power save control signal opc.

An effective way to enhance the stability of the voltage follower circuit VF is to equalize drain currents of the first and the second driving transistors NTO1 and PTO1 included in the output circuit 120. The drain current of the first driving transistor NTO1 is determined by a current value I1 of the first current source CS1 in operation of the P differential amplifying circuit 100 and a current value I3 of the third current source C3 in operation of the first auxiliary circuit 130. The drain current of the second driving transistor PTO1 is determined by a current value I2 of the second current source CS2 in operation of the N differential amplifying circuit 110 and a current value I4 of the fourth current source C4 in operation of the second auxiliary circuit 140.

Here, it is assumed that the current values I1 and I3 are not equal. For example, suppose the current value I1 is 10, while the current value I3 is 5. Also, it is assumed that the current values I2 and I4 are not equal. For example, suppose the current value I2 is 10, while the current value I4 is 5.

If the voltage of the input signal Vin is within a range for making the P differential amplifying circuit 100 and the first auxiliary circuit 130 operate, the drain current of the first driving transistor NTO1 totals, for example, 15 (=I1+I3=10+5). Likewise, if the voltage of the input signal Vin is within a range for making the N differential amplifying circuit 110 and the second auxiliary circuit 140 operate, the drain current of the second driving transistor PTO1 totals, for example, 15 (=I2+I4=10+5).

Meanwhile, if the voltage of the input signal Vin decreases to an extent that the N-channel transistors no longer operate, the N differential amplifying circuit 110 and the first auxiliary circuit 130 do not also operate. Consequently, the second current source CS2 and the third current source CS3 do not flow a current (I2=0, I3=0). As a result, the drain current of the first driving transistor NTO1 totals 10 (=I1), while the drain current of the second driving transistor PTO1 totals 5 (=I4), for example. The same thing happens when the voltage of the input signal Vin increases to an extent that the P-channel transistors no longer operate.

Accordingly, if the first and second driving transistors NTO1 and PTO1 included in the output circuit 120 have different drain currents and different rising or falling of the output signal Vout, time required for stabilizing an output is different between the two, and thereby making it easy to oscillate.

Therefore, the voltage follower circuit VF according to the present embodiment preferably has current values of the first and third current sources CS1 and CS3 in operation that are equal (I1=I3) and current values of the second and fourth current sources CS2 and CS4 in operation that are equal (I2=I4). This adjustment can be made by equalizing channel lengths L of the transistors included in the first to fourth current sources CS1 to CS4, and equalizing channel widths of the transistors included in the first and third current sources CS1 and CS3 and of the transistors included in the second and fourth current sources CS2 and CS4.

Further, current values of the first to fourth current sources CS1 to CS4 in operation are preferably equalized (I1=I2=I3=I4) to make designing of them easy.

Power consumption can be further reduced by reducing at least one of the current values of the third and fourth current sources CS3 and CS4 in operation. In this case, it is necessary to reduce at least one of the current values of the third and fourth current sources CS3 and CS4 in operation without lowering the current driving capability of the first to fourth current driving transistors PA1, PA2, NA3, and NA4.

Figure 33:
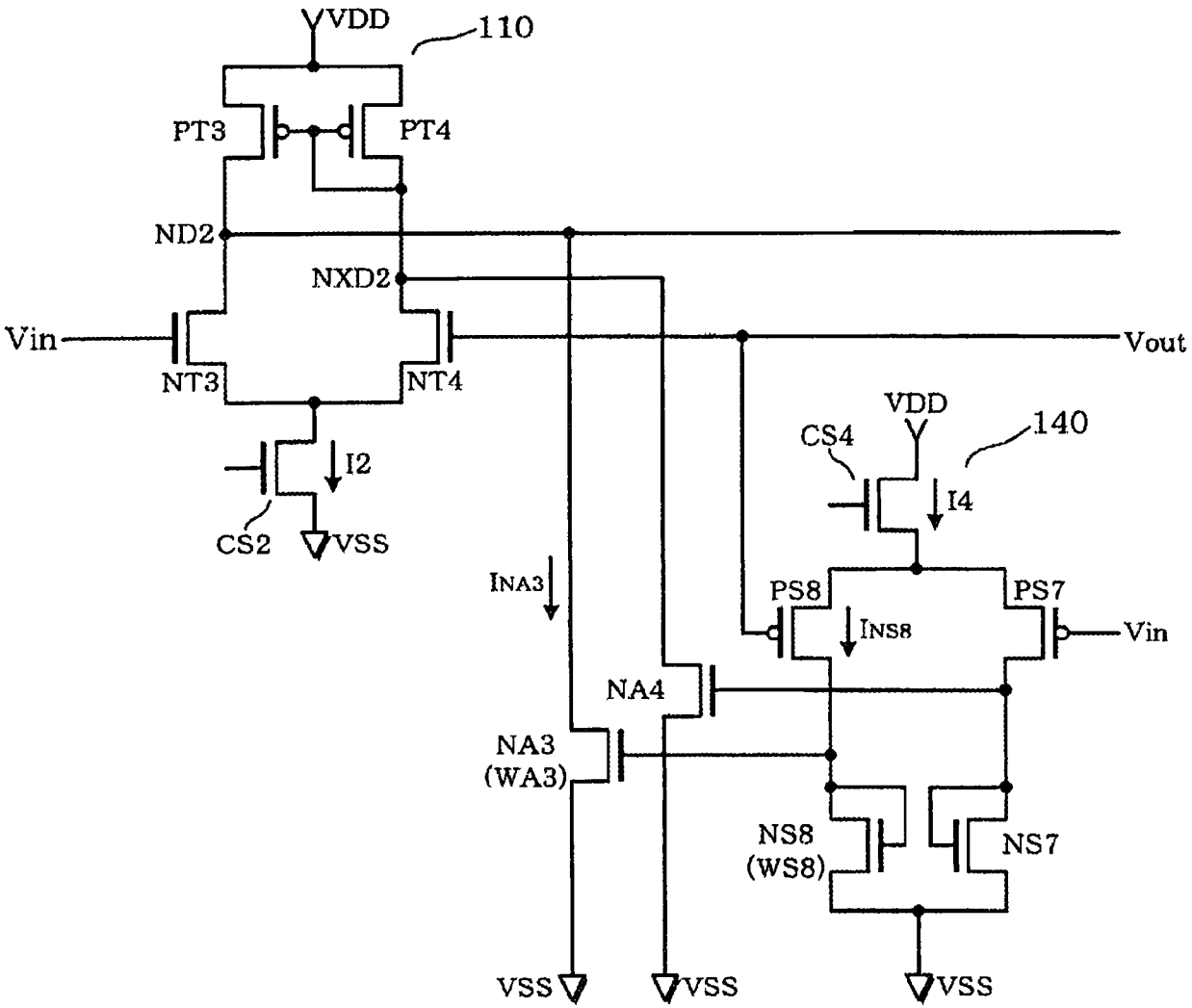
FIG. 33 illustrates an example configuration to cut current values of a fourth current source in operation.

FIG. 33 illustrates an example configuration to cut current values of the fourth current source CS4 in operation. The parts same as shown in FIGS. 23, 26, and 32 are given the same numerals in FIG. 33 and the explanation thereof will be omitted here. While a transistor for controlling power save is not shown in FIG. 33, it should be understood that unnecessary power consumption at current sources can be reduced as mentioned above by means of the control with the power save control signal opc.

Referring to FIG. 33, a current mirror circuit composed of the third and eighth current driving transistors NA3 and NS8 is utilized to reduce the current value of the fourth current source CS4 in operation. The drain current $I_{NA3}$ of the third current driving transistor NA3 and the drain current $I_{NS8}$ of the eighth current driving transistor NS8 are put into the formula:

$$I_{NA3}=(WA3/WS8)*I_{NS8}$$

where WA3 represents the channel width of the third transistor NA3 and WS8 represents the channel width of the eighth transistor NS8. The value (WA3/WS8) represents a ratio of the current driving capability of the third current driving transistor NA3 to that of the eighth current driving transistor NA8. Accordingly, by making the value (WA3/WS8) larger than 1, the drain current $I_{NS8}$ can be decreased without lowering the current driving capacity of the third current driving transistor NAS3, and the current value I4 of the fourth current source CS4 in operation can be also decreased.

It should be noted that a current mirror circuit composed of the fourth and seventh current driving transistors NA4 and NS7 may also be utilized in FIG. 33.

Furthermore, the current value of the third current source CS3 in operation is also preferably reduced. In this case, a current mirror circuit composed of the first and sixth current driving transistors PA1 and PS6, or composed of the second and fifth current driving transistors PA2 and PS5 may be utilized.

Accordingly, making at least one of the following larger than 1 can reduce the current value of at least one of the third and fourth current sources CS3 and CS4 in operation: the ratio of the current driving capacity of the first current driving transistor PA1 to that of the sixth current driving transistor PS6, the ratio of the current driving capacity of the second current driving transistor PA2 to that of the fifth current driving transistor PS5, the ratio of the current driving capacity of the third current driving transistor NA3 to that of the eighth current driving transistor NS8, and the ratio of the current driving capacity of the fourth current driving transistor NA4 to that of the seventh current driving transistor NS7.

3. Power Supply Circuit

Figure 34:
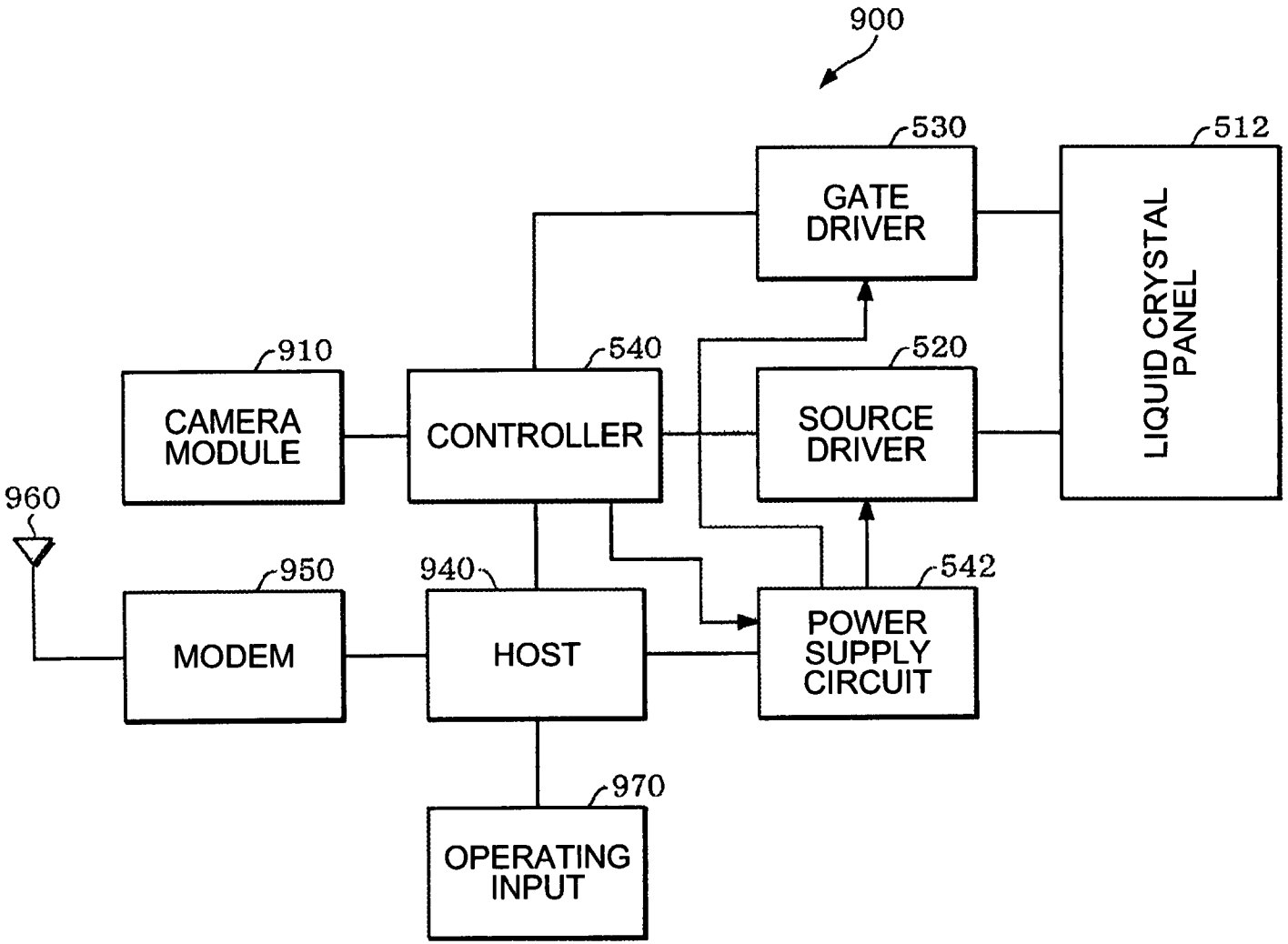
FIG. 34 is a block diagram showing an example configuration of electronic apparatuses according to one embodiment of the invention.

FIG. 34 is a block diagram showing an example configuration of a power supply circuit according to the present embodiment. This diagram shows an example configuration of a cellular phone as an electronic apparatus. The parts same as shown in FIG. 1 are given the same numerals in FIG. 34 and the explanation thereof will be omitted here.

This cellular phone 900 includes a camera module 910. The camera module 910 includes a CCD camera to supply data of images captured by the CCD camera to the controller 300 in YUV format.

The cellular phone 900 also includes the liquid crystal panel 512. The liquid crystal panel 512 is driven by the source driver 520 and the gate driver 530. The liquid crystal panel 512 includes a plurality of gate lines, a plurality of source lines, and a plurality of pixels.

The controller 540 is coupled to the source driver 520 and the gate driver 530, and supplies display data to the source driver 520 in RGB format.

The power supply circuit 542 is coupled to the source driver 520 and the gate driver 530, and supplies a driving power supply voltage to each driver.

Coupled to the controller 540 is a host 940. The host 940 controls the controller 540. The host 940 also demodulates display data, received via an antenna 960, with a modem 950, and then supplies the data to the controller 540. The controller 540 has images displayed on the liquid crystal panel 512 based on the display data with the source driver 520 and the gate driver 530.

The host 940 modulates the display data, generated by the camera module 910, with the modem 950, and may direct the transmission of the data to other communication apparatuses via the antenna 960.

Based on operational information from an operating input 970, the host 940 perform processing of display data transmission and reception, imaging with the camera module 910, and displaying with the liquid crystal panel 512.

It should be noted that the invention is not limited to the above-mentioned embodiments, and various changes can be made within the scope of the invention. For example, while the liquid crystal display panel as a display panel is described, this is not intended to limit the invention. Also, while each transistor is described as a MOS transistor, it should be understood that the invention is not limited to this.

In addition, the above-mentioned configurations of the voltage follower circuit and the P differential amplifying circuit, the N differential amplifying circuit, the output circuit, the first auxiliary circuit, and the second auxiliary circuit, included in the voltage follower circuit, are not intended to limit the invention, and various equivalent configurations may be also used.

Part of requirements of any claim of the present invention could be omitted from a dependent claim which depends on that claim. Moreover, part of requirements of any independent claim of the present invention could be made to depend on any other independent claim.

Although only some embodiments of the present invention have been described in detail above, those skilled in the art will readily appreciate that many modifications are possible in the embodiments without materially departing from the novel teachings and advantages of this invention. Accordingly, all such modifications are intended to be included within scope of this invention.

What is claimed is:

1. A source driver for driving a source line included in an electro-optical device, the source driver comprising:

an impedance conversion circuit that drives the source line based on a grayscale voltage corresponding to display data;

a first switch circuit including one end coupled to a non-display voltage is supplied and another end coupled to an output of the impedance conversion circuit;

a power save data holding circuit provided corresponding to each impedance conversion circuit or to impedance conversion circuits corresponding to a plurality of dots making up a pixel, and for holding power save data; and a first mask circuit for masking the power save data based on a first mask control signal that varies in unit of a horizontal scan period, when power save control is performed based on an output from the first mask circuit, an operational current of the impedance conversion circuit is suspended or restricted to set an output of the impedance conversion circuit as a high impedance state and the first switch circuit is set to a conducting state, and when power save control is not performed based on an output from the first mask circuit, the impedance conversion circuit drives the output of the impedance conversion circuit based on the grayscale voltage and the first switch circuit is set to a non-conducting state.

2. The source driver as define in claim 1, further comprising:

a second mask circuit that masks the power save data based on a second mask control signal that varies in unit of a horizontal scan period, the first mask circuit masks an output from the second mask circuit based on the first mask control signal.

3. The source driver as define in claim 1, the impedance conversion circuit having a lower phase margin with load unconnected to the output of the impedance conversion circuit than with load connected to the output.

4. The source driver as define in claim 1, further comprising:

a second switch circuit for bypassing an input to and output from the impedance conversion circuit, during a first period within a horizontal scan period specified by a driving period specifying signal that varies within a horizontal scan period, the second switch circuit is set to a non-conducting state based on an output from the first mask circuit and the impedance conversion circuit drives the output of the impedance conversion circuit based on the grayscale voltage, and during a second period following the first period, the second switch circuit is set to a conducting state and an operational current of the impedance conversion circuit is suspended or restricted to set the output of the impedance conversion circuit as a high impedance state.

5. The source driver as define in claim 1, further comprising:

a display data memory for storing the display data, a predetermined bit of the display data read from the display data memory is stored in the power save data holding circuit as power save data.

6. The source driver as define in claim 1, the impedance conversion circuit comprises:

a voltage follower circuit coupled to the grayscale voltage is supplied as an input signal; and a resistance circuit coupled in series with an output of the voltage follower circuit, the voltage follower circuit comprises:

a differential part that amplifies a differential between the input signal and an output signal from the voltage follower circuit; and an output part that outputs an output signal from the voltage follower circuit based on an output from the differential part, and the source line being driven via the resistance circuit.

7. The source driver as define in claim 6, a slew rate at an output of the differential part being equal to or larger than a slew rate at an output of the output part.

8. An electro-optical device, comprising:

a plurality of source lines;

a plurality of gate lines;

a plurality of switching elements, each of the switching elements being coupled to one of the plurality of gate lines and one of the plurality of source lines;

a gate driver for scanning the plurality of gate lines; and the source driver as define in claim 1 that drives the plurality of source lines.

9. An electronic apparatus, comprising:

the electro-optical device as define in claim 8.

10. A method for driving a source line included in an electro-optical device, comprising:

holding power save data for each impedance conversion circuit that drives the source line based on a grayscale voltage corresponding to display data or for impedance conversion circuits corresponding to a plurality of dots making up a pixel; and based on a result of masking the power save data based on a first mask control signal that varies in unit of a horizontal scan period, suspending or restricting an operational current of the impedance conversion circuit to set an output of the impedance conversion circuit as a high impedance state and supplying a non-display voltage to the output of the impedance conversion circuit, or making the impedance conversion circuit drive the output of the impedance conversion circuit based on the grayscale voltage.

11. The method for driving a source line as define in claim 10, further comprising:

based on the first mask control signal, masking a result of masking the power save data based on a second mask control signal that varies in unit of a horizontal scan period; and based on a result of masking based on the first mask control signal, suspending or restricting an operational current of the impedance conversion circuit to set the output of the impedance conversion circuit as a high impedance state and supplying a non-display voltage to the output of the impedance conversion circuit, or making the impedance conversion circuit drive the output of the impedance conversion circuit based on the grayscale voltage.

* * * * *